US008804970B2

(12) United States Patent
Grill et al.

(10) Patent No.: US 8,804,970 B2
(45) Date of Patent: Aug. 12, 2014

(54) LOW BITRATE AUDIO ENCODING/DECODING SCHEME WITH COMMON PREPROCESSING

(75) Inventors: Bernhard Grill, Lauf (DE); Stefan Bayer, Nuremberg (DE); Guillaume Fuchs, Erlangen (DE); Stefan Geyersberger, Wuerzburg (DE); Ralf Geiger, Nuremberg (DE); Johannes Hilpert, Nuremberg (DE); Ulrich Kraemer, Stuttgart (DE); Jeremie Lecomte, Fŏrth (DE); Markus Multrus, Nuremberg (DE); Max Neuendorf, Nuremberg (DE); Harald Popp, Tuchenbach (DE); Nikolaus Rettelbach, Nuremberg (DE); Frederik Nagel, Nuremberg (DE); Sascha Disch, Fuerth (DE); Juergen Herre, Buckenhof (DE); Yoshikazu Yokotani, Langen (DE); Stefan Wabnik, Ilmenau (DE); Gerald Schuller, Erfurt (DE); Jens Hirschfeld, Heringen (DE)

(73) Assignee: Fraunhofer-Gesellschaft zur Foerderung der Angewandten Forschung E.V., Munich (DE)

( * ) Notice: Subject to any disclaimer, the term of this patent is extended or adjusted under 35 U.S.C. 154(b) by 539 days.

(21) Appl. No.: 13/004,453

(22) Filed: Jan. 11, 2011

(65) Prior Publication Data

US 2011/0200198 A1 Aug. 18, 2011

Related U.S. Application Data

(63) Continuation of application No. PCT/EP2009/004873, filed on Jul. 6, 2009.

(60) Provisional application No. 61/079,861, filed on Jul. 11, 2008.

(30) Foreign Application Priority Data

Oct. 8, 2008 (EP) ..... 08017662
Feb. 18, 2009 (EP) ..... 09002272

(51) Int. Cl.
*G10L 21/00* (2013.01)

(52) U.S. Cl.
USPC ..... 381/23; 381/1; 381/2; 381/20; 381/21; 381/22; 700/94; 704/500; 704/200; 704/201; 704/205; 704/211; 704/212; 704/222

(58) Field of Classification Search
USPC ..... 381/1, 2, 20, 21–23; 700/94; 704/500, 704/200, 201, 205, 211, 212, 222
See application file for complete search history.

(56) References Cited

U.S. PATENT DOCUMENTS 6,447,490 B1 9/2002 Liu et al.

(Continued)

FOREIGN PATENT DOCUMENTS

EP 1278184 1/2003
EP 2311035 4/2011

(Continued)

OTHER PUBLICATIONS

Kim et al, A Preprocessor for low bit rate speech coding, IEEE, Oct. 2002.*

(Continued)

*Primary Examiner* — Davetta W Goins
*Assistant Examiner* — Kuassi Ganmavo
(74) *Attorney, Agent, or Firm* — Michael A. Glenn; Perkins Coie LLP

(57) ABSTRACT

An audio encoder has a common preprocessing stage, an information sink based encoding branch such as spectral domain encoding branch, a information source based encoding branch such as an LPC-domain encoding branch and a switch for switching between these branches at inputs into these branches or outputs of these branches controlled by a decision stage. An audio decoder has a spectral domain decoding branch, an LPC-domain decoding branch, one or more switches for switching between the branches and a common post-processing stage for post-processing a time-domain audio signal for obtaining a post-processed audio signal.

26 Claims, 16 Drawing Sheets

(Encoder) (Decoder)

(56) References Cited

U.S. PATENT DOCUMENTS

| | | | | |
|---|---|---|---|---|
| 6,477,490 | B2 * | 11/2002 | Nakatoh et al. | 704/200.1 |
| 6,532,443 | B1 | 3/2003 | Nishiguchi et al. | |
| 6,658,383 | B2 * | 12/2003 | Koishida et al. | 704/229 |
| 6,785,645 | B2 | 8/2004 | Khalil et al. | |
| 7,933,769 | B2 * | 4/2011 | Bessette | 704/219 |
| 7,979,271 | B2 * | 7/2011 | Bessette | 704/219 |
| 8,428,958 | B2 * | 4/2013 | Sung et al. | 704/500 |
| 2003/0004711 | A1 | 1/2003 | Koishida | |
| 2003/0093264 | A1 | 5/2003 | Miyasaka et al. | |
| 2003/0139923 | A1 | 7/2003 | Wang et al. | |
| 2005/0163323 | A1 | 7/2005 | Oshikiri et al. | |
| 2005/0261900 | A1 * | 11/2005 | Ojala et al. | 704/223 |
| 2006/0173675 | A1 * | 8/2006 | Ojanpera | 704/203 |
| 2007/0100607 | A1 * | 5/2007 | Villemoes | 704/207 |
| 2008/0004869 | A1 | 1/2008 | Herre et al. | |
| 2008/0147414 | A1 * | 6/2008 | Son et al. | 704/500 |

FOREIGN PATENT DOCUMENTS

| | | |
|---|---|---|
| KR | 10-2008-0061758 | 7/2008 |
| TW | 332889 | 6/1998 |
| TW | 380246 | 1/2000 |
| TW | 564400 | 12/2003 |
| TW | 591606 | 6/2004 |
| TW | 200623027 | 7/2006 |
| WO | 2007008001 | 1/2007 |
| WO | 2008000316 | 1/2008 |

OTHER PUBLICATIONS

TSG-SA WG4, 3GPP TS 26.290 version 2.0.0 Extended Adaptive multi rate wideband codec transcoding function release 6, Sep. 13-16, 2004.*

Speech Coding: A tutorial Review, Andreas Spanias, Proceedings of the IEEE, vol. 82, Issue No. 10, Oct. 1994.

PCT/EP2009/004718 International Search Report and Written Opinion; 16 pages; mailed date Jul. 12, 2009.

* cited by examiner (Encoder)

(Decoder)

(Encoder)

(Decoder)

analysis-by-synthesis CELP $A_L(z)$: long term prediction
≙pitch (fine) structure A(z): short term prediction
≙ formant structure / spectral envelope

LOW BITRATE AUDIO ENCODING/DECODING SCHEME WITH COMMON PREPROCESSING

CROSS-REFERENCE TO RELATED APPLICATIONS

This application is a continuation of copending International Application No. PCT/EP2009/004873 filed Jul. 6, 2009, and claims priority to U.S. Application No. 61/079,861, filed Jul. 11, 2008, and additionally claims priority from European Application No. 08017662.1, filed Oct. 8, 2008, and European Application No. 09002272.4, filed Feb. 18, 2009; all of which are incorporated herein by reference in their entirety.

BACKGROUND OF THE INVENTION

The present invention is related to audio coding and, particularly, to low bit rate audio coding schemes.

In the art, frequency domain coding schemes such as MP3 or AAC are known. These frequency-domain encoders are based on a time-domain/frequency-domain conversion, a subsequent quantization stage, in which the quantization error is controlled using information from a psychoacoustic module, and an encoding stage, in which the quantized spectral coefficients and corresponding side information are entropy-encoded using code tables.

On the other hand there are encoders that are very well suited to speech processing such as the AMR-WB+ as described in 3GPP TS 26.290. Such speech coding schemes perform a Linear Predictive filtering of a time-domain signal. Such a LP filtering is derived from a Linear Prediction analyze of the input time-domain signal. The resulting LP filter coefficients are then coded and transmitted as side information. The process is known as Linear Prediction Coding (LPC). At the output of the filter, the prediction residual signal or prediction error signal which is also known as the excitation signal is encoded using the analysis-by-synthesis stages of the ACELP encoder or, alternatively, is encoded using a transform encoder, which uses a Fourier transform with an overlap. The decision between the ACELP coding and the Transform Coded eXcitation coding which is also called TCX coding is done using a closed loop or an open loop algorithm.

Frequency-domain audio coding schemes such as the high efficiency-AAC encoding scheme, which combines an AAC coding scheme and a spectral bandwidth replication technique can also be combined to a joint stereo or a multichannel coding tool which is known under the term "MPEG surround".

On the other hand, speech encoders such as the AMR-WB+ also have a high frequency enhancement stage and a stereo functionality.

Frequency-domain coding schemes are advantageous in that they show a high quality at low bit rates for music signals. Problematic, however, is the quality of speech signals at low bit rates.

Speech coding schemes show a high quality for speech signals even at low bit rates, but show a poor quality for music signals at low bit rates.

SUMMARY

According to an embodiment, an audio encoder for generating an encoded audio signal may have a first encoding branch for encoding an audio intermediate signal in accordance with a first coding algorithm, the first coding algorithm having an information sink model and generating, in a first encoding branch output signal, encoded spectral information representing the audio intermediate signal, the first encoding branch having a spectral conversion block for converting the audio intermediate signal into a spectral domain and a spectral audio encoder for encoding an output signal of the spectral conversion block to acquire the encoded spectral information; a second encoding branch for encoding an audio intermediate signal in accordance with a second coding algorithm, the second coding algorithm having an information source model and generating, in a second encoding branch output signal, encoded parameters for the information source model representing the audio intermediate signal, the second encoding branch having an LPC analyzer for analyzing the audio intermediate signal and for outputting an LPC information signal usable for controlling an LPC synthesis filter and an excitation signal, and an excitation encoder for encoding the excitation signal to acquire the encoded parameters; and a common pre-processing stage for pre-processing an audio input signal to acquire the audio intermediate signal, wherein the common preprocessing stage is operative to process the audio input signal so that the audio intermediate signal is a compressed version of the audio input signal.

According to another embodiment, a method of audio encoding for generating an encoded audio signal, may have the steps of encoding an audio intermediate signal in accordance with a first coding algorithm, the first coding algorithm having an information sink model and generating, in a first output signal, encoded spectral information representing the audio signal, the first coding algorithm having a spectral conversion step of converting the audio intermediate signal into a spectral domain and a spectral audio encoding step of encoding an output signal of the spectral conversion step to acquire the encoded spectral information; encoding an audio intermediate signal in accordance with a second coding algorithm, the second coding algorithm having an information source model and generating, in a second output signal, encoded parameters for the information source model representing the intermediate signal, the second encoding branch having a step of LPC analyzing the audio intermediate signal and outputting an LPC information signal usable for controlling an LPC synthesis filter, and an excitation signal, and a step of excitation encoding the excitation signal to acquire the encoded parameters; and commonly pre-processing an audio input signal to acquire the audio intermediate signal, wherein, in the step of commonly preprocessing the audio input signal is processed so that the audio intermediate signal is a compressed version of the audio input signal, wherein the encoded audio signal has, for a certain portion of the audio signal either the first output signal or the second output signal.

According to another embodiment, an audio decoder for decoding an encoded audio signal may have a first decoding branch for decoding an encoded signal encoded in accordance with a first coding algorithm having an information sink model, the first decoding branch having a spectral audio decoder for spectral audio decoding the encoded signal encoded in accordance with a first coding algorithm having an information sink model, and a time-domain converter for converting an output signal of the spectral audio decoder into the time domain; a second decoding branch for decoding an encoded audio signal encoded in accordance with a second coding algorithm having an information source model, the second decoding branch having an excitation decoder for decoding the encoded audio signal encoded in accordance with a second coding algorithm to acquire an LPC domain signal, and an LPC synthesis stage for receiving an LPC information signal generated by an LPC analysis stage and for converting the LPC domain signal into the time domain; a combiner for combining time domain output signals from the time domain converter of the first decoding branch and the LPC synthesis stage of the second decoding branch to acquire a combined signal; and a common post-processing stage for processing the combined signal so that a decoded output signal of the common post-processing stage is an expanded version of the combined signal.

According to another embodiment, a method of audio decoding an encoded audio signal may have the steps of decoding an encoded signal encoded in accordance with a first coding algorithm having an information sink model, having spectral audio decoding the encoded signal encoded in accordance with a first coding algorithm having an information sink model, and time domain converting an output signal of the spectral audio decoding step into the time domain; decoding an encoded audio signal encoded in accordance with a second coding algorithm having an information source model, having excitation decoding the encoded audio signal encoded in accordance with a second coding algorithm to acquire an LPC domain signal, an for receiving an LPC information signal generated by an LPC analysis stage and LPC synthesizing to convert the LPC domain signal into the time domain; combining time domain output signals from the step of time domain converting and the step of LPC synthesizing to acquire a combined signal; and commonly processing the combined signal so that a decoded output signal of the common post-processing stage is an expanded version of the combined signal.

According to another embodiment, a computer program may perform, when running on a computer, one of the above-mentioned methods.

According to another embodiment, an encoded audio signal may have a first encoding branch output signal representing a first portion of an audio signal encoded in accordance with a first coding algorithm, the first coding algorithm having an information sink model, the first encoding branch output signal having encoded spectral information representing the audio signal, the first encoding branch having a spectral conversion block for converting the audio intermediate signal into a spectral domain and a spectral audio encoder for encoding an output signal of the spectral conversion block to acquire the encoded spectral information; a second encoding branch output signal representing a second portion of an audio signal, which is different from the first portion of the output signal, the second portion being encoded in accordance with a second coding algorithm, the second coding algorithm having an information source model, the second encoding branch output signal having encoded parameters for the information source model representing the intermediate signal, the second encoding branch having an LPC analyzer for analyzing the audio intermediate signal and for outputting an LPC information signal usable for controlling an LPC synthesis filter and an excitation signal, and an excitation encoder for encoding the excitation signal to acquire the encoded parameters; and common pre-processing parameters representing differences between the audio signal and an expanded version of the audio signal.

In an aspect of the present invention, a decision stage controlling a switch is used to feed the output of a common preprocessing stage either into one of two branches. One is mainly motivated by a source model and/or by objective measurements such as SNR, the other one by a sink model and/or a psychoacoustic model, i.e. by auditory masking. Exemplarily, one branch has a frequency domain encoder and the other branch has an LPC-domain encoder such as a speech coder. The source model is usually the speech processing and therefore LPC is commonly used. Thus, typical preprocessing stages such as a joint stereo or multi-channel coding stage and/or a bandwidth extension stage are commonly used for both coding algorithms, which saves a considerable amount of storage, chip area, power consumption, etc. compared to the situation, where a complete audio encoder and a complete speech coder are used for the same purpose.

In an embodiment, an audio encoder has a common preprocessing stage for two branches, wherein a first branch is mainly motivated by a sink model and/or a psychoacoustic model, i.e. by auditory masking, and wherein a second branch is mainly motivated by a source model and by segmental SNR calculations. The audio encoder has one or more switches for switching between these branches at inputs into these branches or outputs of these branches controlled by a decision stage. In the audio encoder the first branch includes a psycho acoustically based audio encoder, and wherein the second branch includes an LPC and an SNR analyzer.

In an embodiment, an audio decoder comprises an information sink based decoding branch such as a spectral domain decoding branch, an information source based decoding branch such as an LPC-domain decoding branch, a switch for switching between the branches and a common post-processing stage for post-processing a time-domain audio signal for obtaining a post-processed audio signal.

An encoded audio signal in accordance with a further aspect of the invention comprises a first encoding branch output signal representing a first portion of an audio signal encoded in accordance with a first coding algorithm, the first coding algorithm having an information sink model, the first encoding branch output signal having encoded spectral information representing the audio signal; a second encoding branch output signal representing a second portion of an audio signal, which is different from the first portion of the output signal, the second portion being encoded in accordance with a second coding algorithm, the second coding algorithm having an information source model, the second encoding branch output signal having encoded parameters for the information source model representing the intermediate signal; and common preprocessing parameters representing differences between the audio signal and an expanded version of the audio signal.

BRIEF DESCRIPTION OF THE DRAWINGS

Embodiments of the present invention are subsequently described with respect to the attached drawings, in which.

DETAILED DESCRIPTION OF THE INVENTION

Figure 1A:
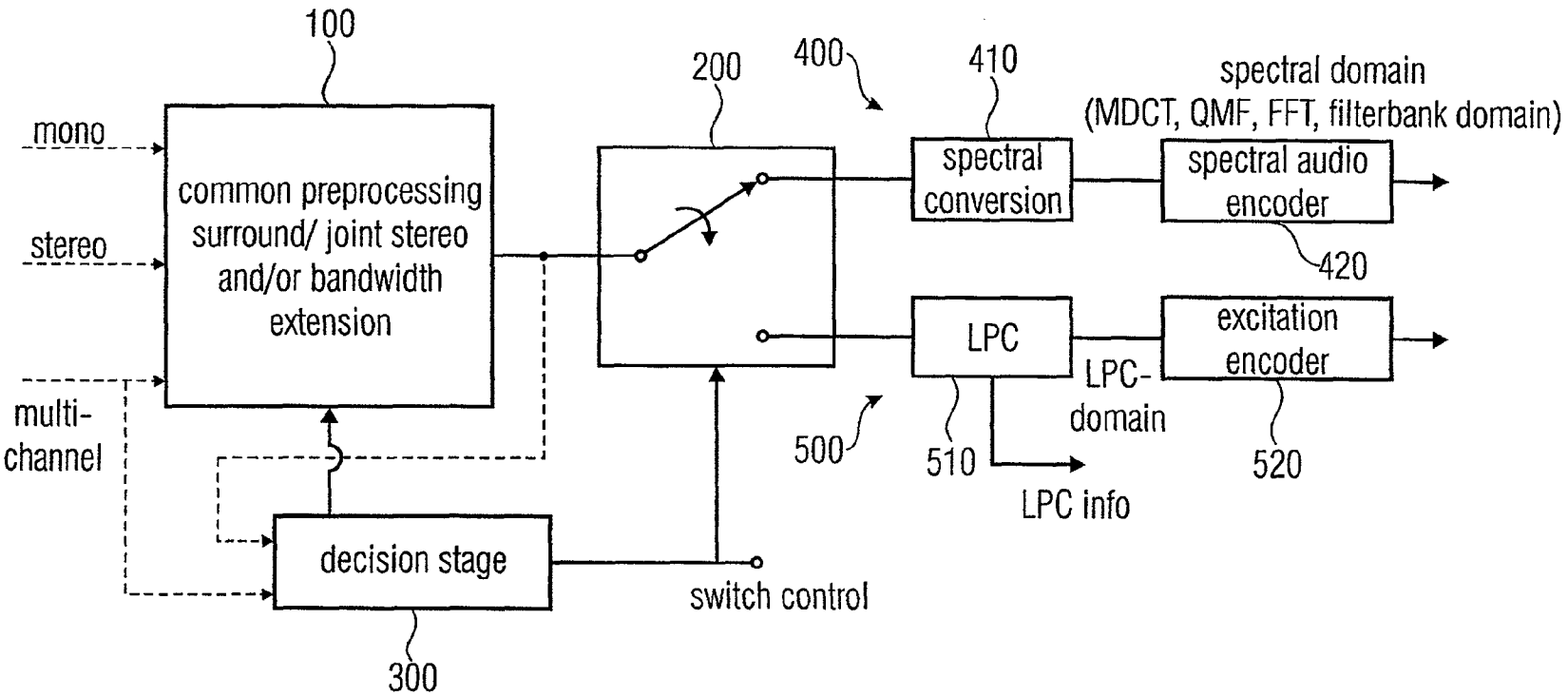
FIG. 1*a* is a block diagram of an encoding scheme in accordance with a first aspect of the present invention.

A mono signal, a stereo signal or a multi-channel signal is input into a common preprocessing stage 100 in FIG. 1*a*. The common preprocessing scheme may have a joint stereo functionality, a surround functionality, and/or a bandwidth extension functionality. At the output of block 100 there is a mono channel, a stereo channel or multiple channels which is input into a switch 200 or multiple switches of type 200.

The switch 200 can exist for each output of stage 100, when stage 100 has two or more outputs, i.e., when stage 100 outputs a stereo signal or a multi-channel signal. Exemplarily, the first channel of a stereo signal could be a speech channel and the second channel of the stereo signal could be a music channel. In this situation, the decision in the decision stage can be different between the two channels for the same time instant.

The switch 200 is controlled by a decision stage 300. The decision stage receives, as an input, a signal input into block 100 or a signal output by block 100. Alternatively, the decision stage 300 may also receive a side information which is included in the mono signal, the stereo signal or the multi-channel signal or is at least associated to such a signal, where information is existing, which was, for example, generated when originally producing the mono signal, the stereo signal or the multi-channel signal.

In one embodiment, the decision stage does not control the preprocessing stage 100, and the arrow between block 300 and 100 does not exist. In a further embodiment, the processing in block 100 is controlled to a certain degree by the decision stage 300 in order to set one or more parameters in block 100 based on the decision. This will, however not influence the general algorithm in block 100 so that the main functionality in block 100 is active irrespective of the decision in stage 300.

The decision stage 300 actuates the switch 200 in order to feed the output of the common preprocessing stage either in a frequency encoding portion 400 illustrated at an upper branch of FIG. 1*a* or an LPC-domain encoding portion 500 illustrated at a lower branch in FIG. 1*a*.

In one embodiment, the switch 200 switches between the two coding branches 400, 500. In a further embodiment, there can be additional encoding branches such as a third encoding branch or even a fourth encoding branch or even more encoding branches. In an embodiment with three encoding branches, the third encoding branch could be similar to the second encoding branch, but could include an excitation encoder different from the excitation encoder 520 in the second branch 500. In this embodiment, the second branch comprises the LPC stage 510 and a codebook based excitation encoder such as in ACELP, and the third branch comprises an LPC stage and an excitation encoder operating on a spectral representation of the LPC stage output signal.

A key element of the frequency domain encoding branch is a spectral conversion block 410 which is operative to convert the common preprocessing stage output signal into a spectral domain. The spectral conversion block may include an MDCT algorithm, a QMF, an FFT algorithm, Wavelet analysis or a filterbank such as a critically sampled filterbank having a certain number of filterbank channels, where the subband signals in this filterbank may be real valued signals or complex valued signals. The output of the spectral conversion block 410 is encoded using a spectral audio encoder 420, which may include processing blocks as known from the AAC coding scheme.

In the lower encoding branch 500, a key element is an source model analyzer such as LPC 510, which outputs two kinds of signals. One signal is an LPC information signal which is used for controlling the filter characteristic of an LPC synthesis filter. This LPC information is transmitted to a decoder. The other LPC stage 510 output signal is an excitation signal or an LPC-domain signal, which is input into an excitation encoder 520. The excitation encoder 520 may come from any source-filter model encoder such as a CELP encoder, an ACELP encoder or any other encoder which processes a LPC domain signal.

Another excitation encoder implementation is a transform coding of the excitation signal. In this embodiment, the excitation signal is not encoded using an ACELP codebook mechanism, but the excitation signal is converted into a spectral representation and the spectral representation values such as subband signals in case of a filterbank or frequency coefficients in case of a transform such as an FFT are encoded to obtain a data compression. An implementation of this kind of excitation encoder is the TCX coding mode known from AMR-WB+.

The decision in the decision stage can be signal-adaptive so that the decision stage performs a music/speech discrimination and controls the switch 200 in such a way that music signals are input into the upper branch 400, and speech signals are input into the lower branch 500. In one embodiment, the decision stage is feeding its decision information into an output bit stream, so that a decoder can use this decision information in order to perform the correct decoding operations.

Figure 1B:
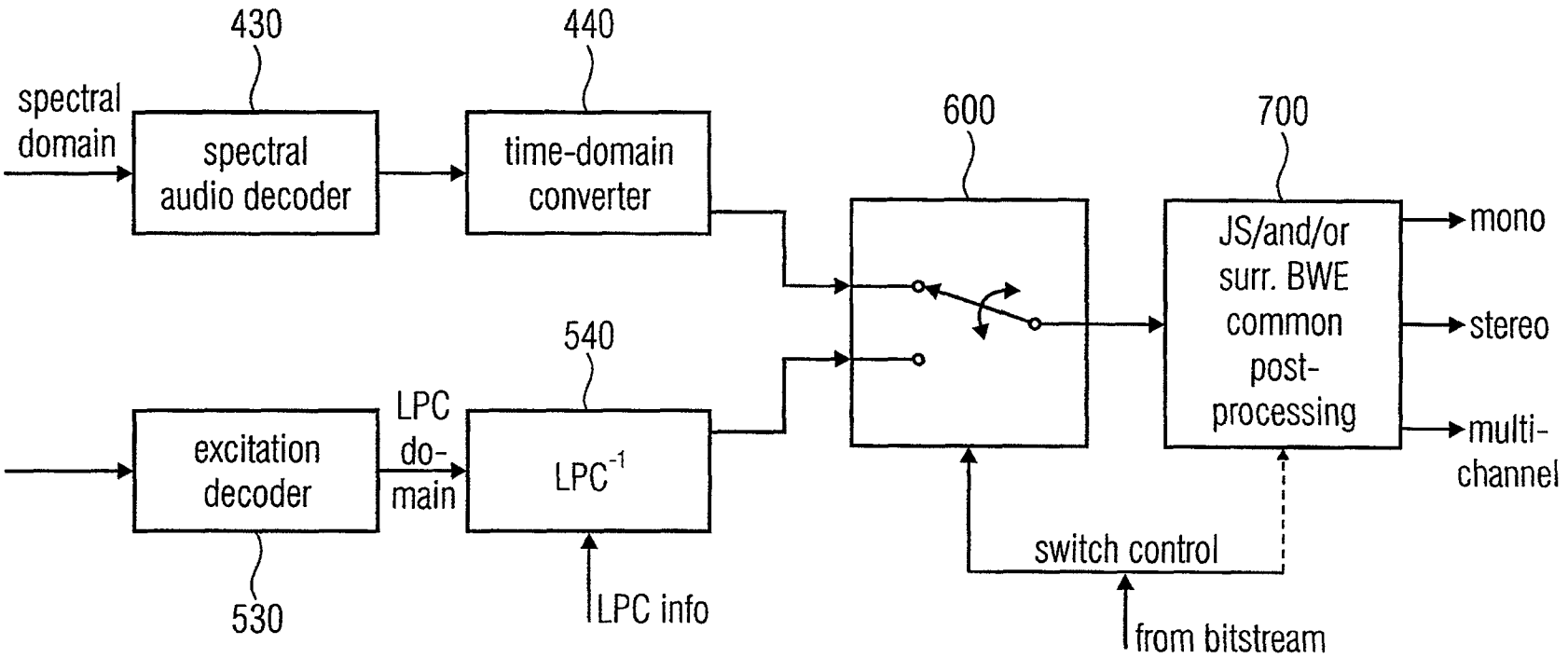
FIG. 1*b* is a block diagram of a decoding scheme in accordance with the first aspect of the present invention.

Such a decoder is illustrated in FIG. 1*b*. The signal output by the spectral audio encoder 420 is, after transmission, input into a spectral audio decoder 430. The output of the spectral audio decoder 430 is input into a time-domain converter 440. Analogously, the output of the excitation encoder 520 of FIG. 1*a* is input into an excitation decoder 530 which outputs an LPC-domain signal. The LPC-domain signal is input into an LPC synthesis stage 540, which receives, as a further input, the LPC information generated by the corresponding LPC analysis stage 510. The output of the time-domain converter 440 and/or the output of the LPC synthesis stage 540 are input into a switch 600. The switch 600 is controlled via a switch control signal which was, for example, generated by the decision stage 300, or which was externally provided such as by a creator of the original mono signal, stereo signal or multi-channel signal.

The output of the switch 600 is a complete mono signal which is, subsequently, input into a common post-processing stage 700, which may perform a joint stereo processing or a bandwidth extension processing etc. Alternatively, the output of the switch could also be a stereo signal or even a multi-channel signal. It is a stereo signal, when the preprocessing includes a channel reduction to two channels. It can even be a multi-channel signal, when a channel reduction to three channels or no channel reduction at all but only a spectral band replication is performed.

Depending on the specific functionality of the common post-processing stage, a mono signal, a stereo signal or a multi-channel signal is output which has, when the common post-processing stage 700 performs a bandwidth extension operation, a larger bandwidth than the signal input into block 700.

In one embodiment, the switch 600 switches between the two decoding branches 430, 440 and 530, 540. In a further embodiment, there can be additional decoding branches such as a third decoding branch or even a fourth decoding branch or even more decoding branches. In an embodiment with three decoding branches, the third decoding branch could be similar to the second decoding branch, but could include an excitation decoder different from the excitation decoder 530 in the second branch 530, 540. In this embodiment, the second branch comprises the LPC stage 540 and a codebook based excitation decoder such as in ACELP, and the third branch comprises an LPC stage and an excitation decoder operating on a spectral representation of the LPC stage 540 output signal.

Figure 2A:
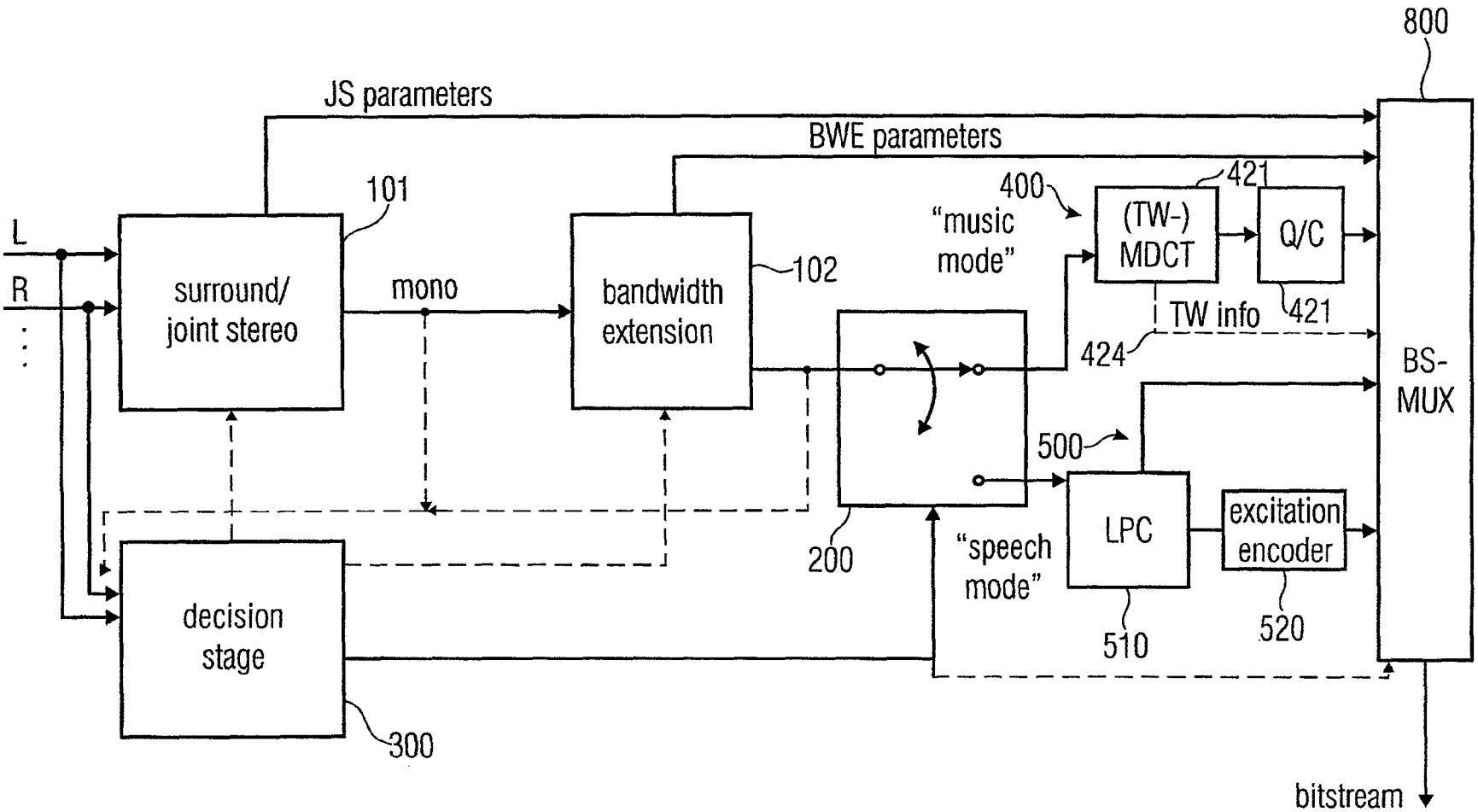
FIG. 2*a* is a block diagram of an encoding scheme in accordance with a second aspect of the present invention.

As stated before, FIG. 2*a* illustrates an encoding scheme in accordance with a second aspect of the invention. The common preprocessing scheme in 100 from FIG. 1*a* now comprises a surround/joint stereo block 101 which generates, as an output, joint stereo parameters and a mono output signal, which is generated by downmixing the input signal which is a signal having two or more channels. Generally, the signal at the output of block 101 can also be a signal having more channels, but due to the downmixing functionality of block 101, the number of channels at the output of block 101 will be smaller than the number of channels input into block 101.

The output of block 101 is input into a bandwidth extension block 102 which, in the encoder of FIG. 2*a*, outputs a band-limited signal such as the low band signal or the low pass signal at its output. Furthermore, for the high band of the signal input into block 102, bandwidth extension parameters such as spectral envelope parameters, inverse filtering parameters, noise floor parameters etc. as known from HE-AAC profile of MPEG-4 are generated and forwarded to a bit-stream multiplexer 800.

Advantageously, the decision stage 300 receives the signal input into block 101 or input into block 102 in order to decide between, for example, a music mode or a speech mode. In the music mode, the upper encoding branch 400 is selected, while, in the speech mode, the lower encoding branch 500 is selected. Advantageously, the decision stage additionally controls the joint stereo block 101 and/or the bandwidth extension block 102 to adapt the functionality of these blocks to the specific signal. Thus, when the decision stage determines that a certain time portion of the input signal is of the first mode such as the music mode, then specific features of block 101 and/or block 102 can be controlled by the decision stage 300. Alternatively, when the decision stage 300 determines that the signal is in a speech mode or, generally, in a LPC-domain coding mode, then specific features of blocks 101 and 102 can be controlled in accordance with the decision stage output.

Depending on the decision of the switch, which can be derived from the switch 200 input signal or from any external source such as a producer of the original audio signal underlying the signal input into stage 200, the switch switches between the frequency encoding branch 400 and the LPC encoding branch 500. The frequency encoding branch 400 comprises a spectral conversion stage 410 and a subsequently connected quantizing/coding stage 421 (as shown in FIG. 2*a*). The quantizing/coding stage can include any of the functionalities as known from modern frequency-domain encoders such as the AAC encoder. Furthermore, the quantization operation in the quantizing/coding stage 421 can be controlled via a psychoacoustic module which generates psychoacoustic information such as a psychoacoustic masking threshold over the frequency, where this information is input into the stage 421.

Advantageously, the spectral conversion is done using an MDCT operation which, even more advantageously, is the time-warped MDCT operation, where the strength or, generally, the warping strength can be controlled between zero and a high warping strength. In a zero warping strength, the MDCT operation in block 411 is a straight-forward MDCT operation known in the art. The time warping strength together with time warping side information can be transmitted/input into the bitstream multiplexer 800 as side information. Therefore, if TW-MDCT is used, time warp side information should be sent to the bitstream as illustrated by 424 in FIG. 2*a*, and—on the decoder side—time warp side information should be received from the bitstream as illustrated by item 434 in FIG. 2*b*.

In the LPC encoding branch, the LPC-domain encoder may include an ACELP core calculating a pitch gain, a pitch lag and/or codebook information such as a codebook index and a code gain.

In the first coding branch 400, a spectral converter comprises a specifically adapted MDCT operation having certain window functions followed by a quantization/entropy encoding stage which may be a vector quantization stage, but is a quantizer/coder as indicated for the quantizer/coder in the frequency domain coding branch, i.e., in item 421 of FIG. 2*a*.

Figure 2B:
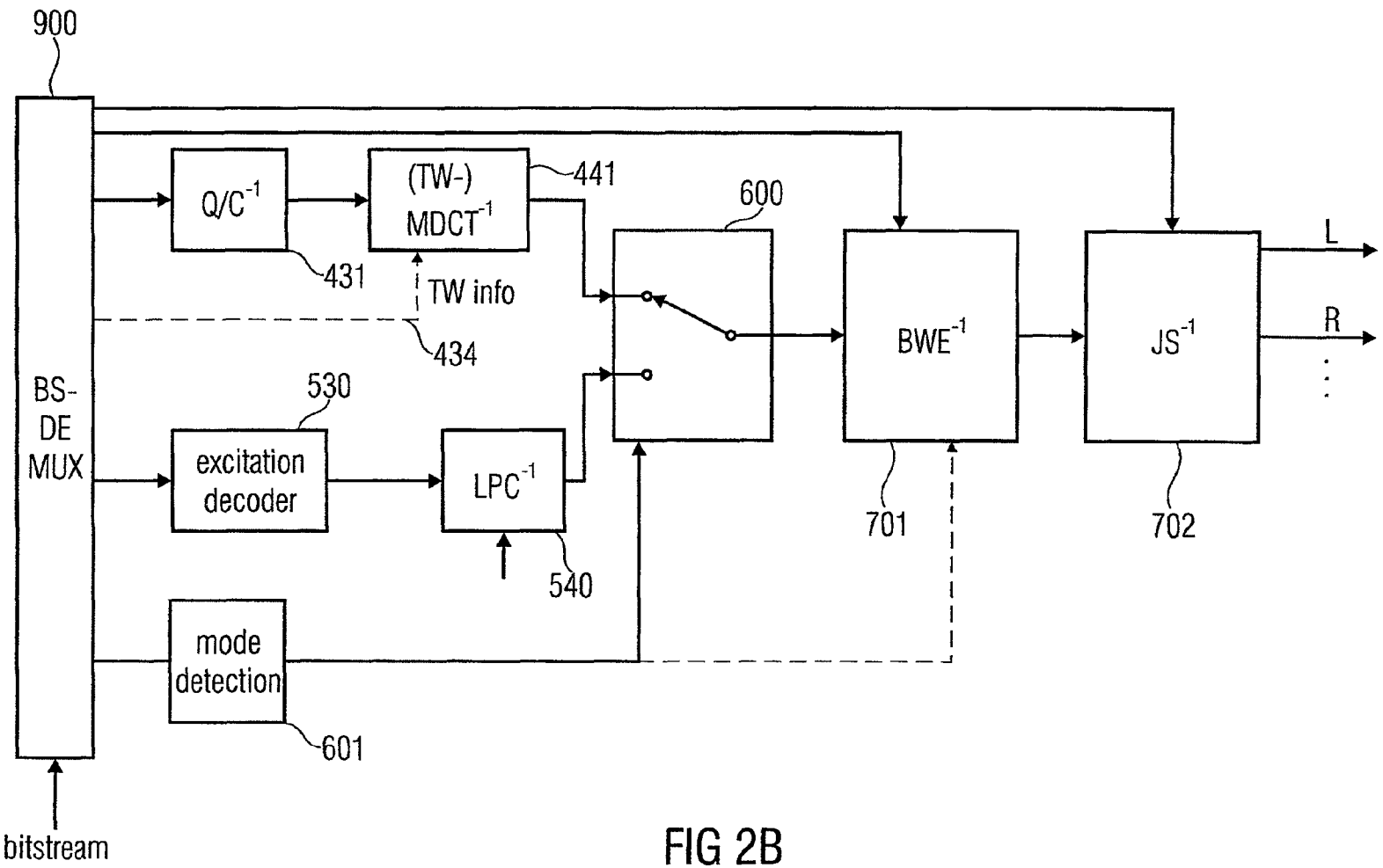
FIG. 2*b* is a schematic diagram of a decoding scheme in accordance with the second aspect of the present invention.

FIG. 2*b* illustrates a decoding scheme corresponding to the encoding scheme of FIG. 2*a*. The bitstream generated by bit-stream multiplexer 800 of FIG. 2*a* is input into a bitstream demultiplexer 900. Depending on an information derived for example from the bitstream via a mode detection block 601, a decoder-side switch 600 is controlled to either forward signals from the upper branch or signals from the lower branch to the bandwidth extension block 701. The bandwidth extension block 701 receives, from the bitstream demultiplexer 900, side information and, based on this side information and the output of the mode detection 601, reconstructs the high band based on the low band output by switch 600.

The full band signal generated by block 701 is input into the joint stereo/surround processing stage 702, which reconstructs two stereo channels or several multi-channels. Generally, block 702 will output more channels than were input into this block. Depending on the application, the input into block 702 may even include two channels such as in a stereo mode and may even include more channels as long as the output by this block has more channels than the input into this block.

Generally, an excitation decoder 530 exists. The algorithm implemented in block 530 is adapted to the corresponding algorithm used in block 520 in the encoder side. While stage 431 outputs a spectrum derived from a time domain signal which is converted into the time-domain using the frequency/time converter 440, stage 530 outputs an LPC-domain signal. The output data of stage 530 is transformed back into the time-domain using an LPC synthesis stage 540, which is controlled via encoder-side generated and transmitted LPC information. Then, subsequent to block 540, both branches have time-domain information which is switched in accordance with a switch control signal in order to finally obtain an audio signal such as a mono signal, a stereo signal or a multi-channel signal.

The switch 200 has been shown to switch between both branches so that only one branch receives a signal to process and the other branch does not receive a signal to process. In an alternative embodiment, however, the switch may also be arranged subsequent to for example the audio encoder 420 and the excitation encoder 520, which means that both branches 400, 500 process the same signal in parallel. In order to not double the bitrate, however, only the signal output by one of those encoding branches 400 or 500 is selected to be written into the output bitstream. The decision stage will then operate so that the signal written into the bitstream minimizes a certain cost function, where the cost function can be the generated bitrate or the generated perceptual distortion or a combined rate/distortion cost function. Therefore, either in this mode or in the mode illustrated in the Figures, the decision stage can also operate in a closed loop mode in order to make sure that, finally, only the encoding branch output is written into the bitstream which has for a given perceptual distortion the lowest bitrate or, for a given bitrate, has the lowest perceptual distortion.

Generally, the processing in branch 400 is a processing in a perception based model or information sink model. Thus, this branch models the human auditory system receiving sound. Contrary thereto, the processing in branch 500 is to generate a signal in the excitation, residual or LPC domain. Generally, the processing in branch 500 is a processing in a speech model or an information generation model. For speech signals, this model is a model of the human speech/sound generation system generating sound. If, however, a sound from a different source requiring a different sound generation model is to be encoded, then the processing in branch 500 may be different.

Although FIGS. 1*a* through 2*b* are illustrated as block diagrams of an apparatus, these figures simultaneously are an illustration of a method, where the block functionalities correspond to the method steps.

Figure 3A:
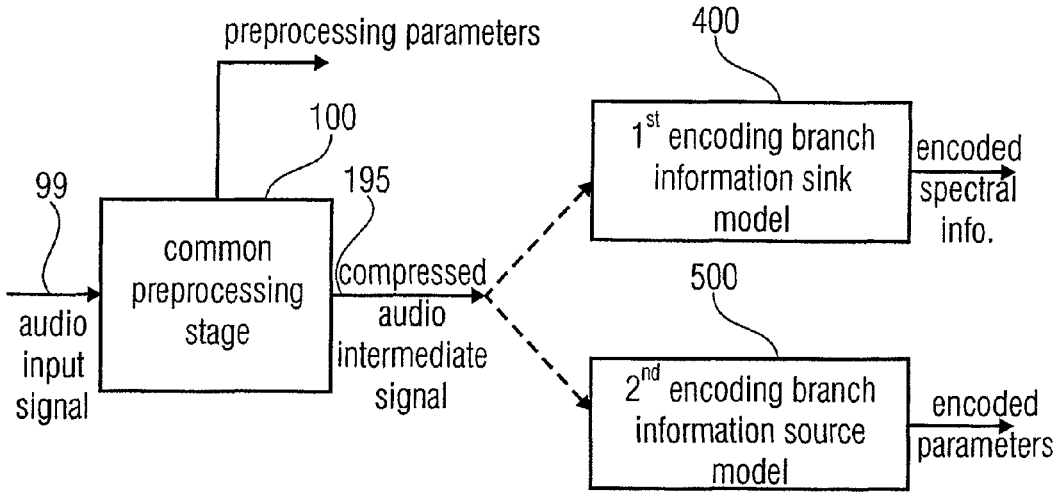
FIG. 3*a* illustrates a block diagram of an encoding scheme in accordance with a further aspect of the present invention.

FIG. 3*a* illustrates an audio encoder for generating an encoded audio signal at an output of the first encoding branch 400 and a second encoding branch 500. Furthermore, the encoded audio signal includes side information such as preprocessing parameters from the common pre-processing stage or, as discussed in connection with preceding Figs., switch control information.

Advantageously, the first encoding branch is operative in order to encode an audio intermediate signal 195 in accordance with a first coding algorithm, wherein the first coding algorithm has an information sink model. The first encoding branch 400 generates the first encoder output signal which is an encoded spectral information representation of the audio intermediate signal 195.

Furthermore, the second encoding branch 500 is adapted for encoding the audio intermediate signal 195 in accordance with a second encoding algorithm, the second coding algorithm having an information source model and generating, in a first encoder output signal, encoded parameters for the information source model representing the intermediate audio signal.

The audio encoder furthermore comprises the common preprocessing stage for pre-processing an audio input signal 99 to obtain the audio intermediate signal 195. Specifically, the common pre-processing stage is operative to process the audio input signal 99 so that the audio intermediate signal 195, i.e., the output of the common preprocessing algorithm is a compressed version of the audio input signal.

A method of audio encoding for generating an encoded audio signal, comprises a step of encoding 400 an audio intermediate signal 195 in accordance with a first coding algorithm, the first coding algorithm having an information sink model and generating, in a first output signal, encoded spectral information representing the audio signal; a step of encoding 500 an audio intermediate signal 195 in accordance with a second coding algorithm, the second coding algorithm having an information source model and generating, in a second output signal, encoded parameters for the information source model representing the intermediate signal 195, and a step of commonly pre-processing 100 an audio input signal 99 to obtain the audio intermediate signal 195, wherein, in the step of commonly pre-processing the audio input signal 99 is processed so that the audio intermediate signal 195 is a compressed version of the audio input signal 99, wherein the encoded audio signal includes, for a certain portion of the audio signal either the first output signal or the second output signal. The method includes the further step encoding a certain portion of the audio intermediate signal either using the first coding algorithm or using the second coding algorithm or encoding the signal using both algorithms and outputting in an encoded signal either the result of the first coding algorithm or the result of the second coding algorithm.

Generally, the audio encoding algorithm used in the first encoding branch 400 reflects and models the situation in an audio sink. The sink of an audio information is normally the human ear. The human ear can be modelled as a frequency analyser. Therefore, the first encoding branch outputs encoded spectral information. The first encoding branch furthermore includes a psychoacoustic model for additionally applying a psychoacoustic masking threshold. This psychoacoustic masking threshold is used when quantizing audio spectral values where the quantization is performed such that a quantization noise is introduced by quantizing the spectral audio values, which are hidden below the psychoacoustic masking threshold.

The second encoding branch represents an information source model, which reflects the generation of audio sound. Therefore, information source models may include a speech model which is reflected by an LPC stage, i.e., by transforming a time domain signal into an LPC domain and by subsequently processing the LPC residual signal, i.e., the excitation signal. Alternative sound source models, however, are sound source models for representing a certain instrument or any other sound generators such as a specific sound source existing in real world. A selection between different sound source models can be performed when several sound source models are available, based on an SNR calculation, i.e., based on a calculation, which of the source models is the best one suitable for encoding a certain time portion and/or frequency portion of an audio signal. Advantageously, however, the switch between encoding branches is performed in the time domain, i.e., that a certain time portion is encoded using one model and a certain different time portion of the intermediate signal is encoded using the other encoding branch.

Information source models are represented by certain parameters. Regarding the speech model, the parameters are LPC parameters and coded excitation parameters, when a modern speech coder such as AMR-WB+ is considered. The AMR-WB+ comprises an ACELP encoder and a TCX encoder. In this case, the coded excitation parameters can be global gain, noise floor, and variable length codes.

Generally, all information source models will allow the setting of a parameter set which reflects the original audio signal very efficiently. Therefore, the output of the second encoding branch will be encoded parameters for the information source model representing the audio intermediate signal.

Figure 3B:
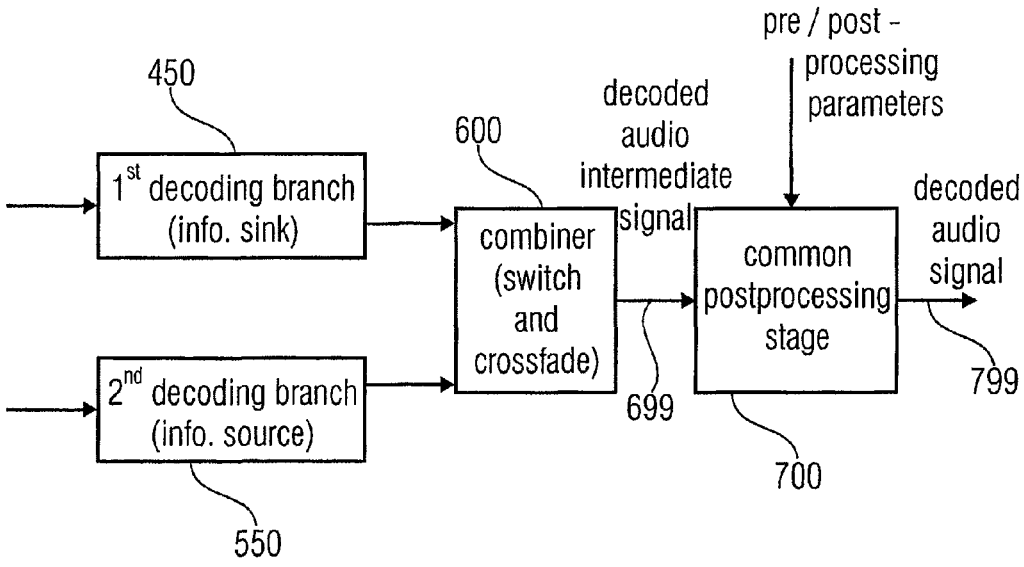
FIG. 3*b* illustrates a block diagram of a decoding scheme in accordance with the further aspect of the present invention.

FIG. 3*b* illustrates a decoder corresponding to the encoder illustrated in FIG. 3*a*. Generally, FIG. 3*b* illustrates an audio decoder for decoding an encoded audio signal to obtain a decoded audio signal 799. The decoder includes the first decoding branch 450 for decoding an encoded signal encoded in accordance with a first coding algorithm having an information sink model. The audio decoder furthermore includes a second decoding branch 550 for decoding an encoded information signal encoded in accordance with a second coding algorithm having an information source model. The audio decoder furthermore includes a combiner for combining output signals from the first decoding branch 450 and the second decoding branch 550 to obtain a combined signal. The combined signal which is illustrated in FIG. 3*b* as the decoded audio intermediate signal 699 is input into a common post processing stage for post processing the decoded audio intermediate signal 699, which is the combined signal output by the combiner 600 so that an output signal of the common pre-processing stage is an expanded version of the combined signal. Thus, the decoded audio signal 799 has an enhanced information content compared to the decoded audio intermediate signal 699. This information expansion is provided by the common post processing stage with the help of pre/post processing parameters which can be transmitted from an encoder to a decoder, or which can be derived from the decoded audio intermediate signal itself. Advantageously, however, pre/post processing parameters are transmitted from an encoder to a decoder, since this procedure allows an improved quality of the decoded audio signal.

Figure 4A:
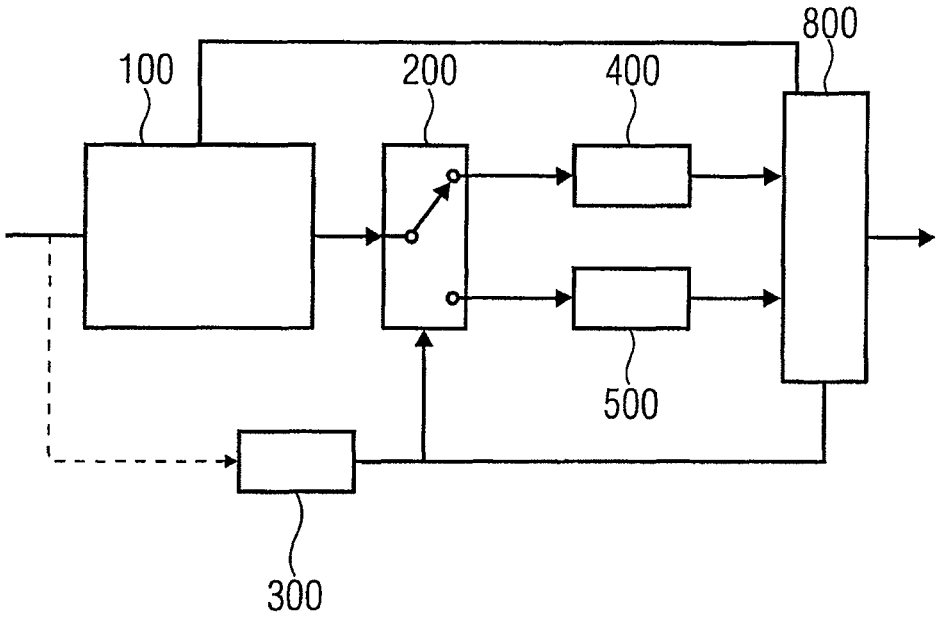
FIG. 4*a* illustrates a block diagram with a switch positioned before the encoding branches.
Figure 4B:
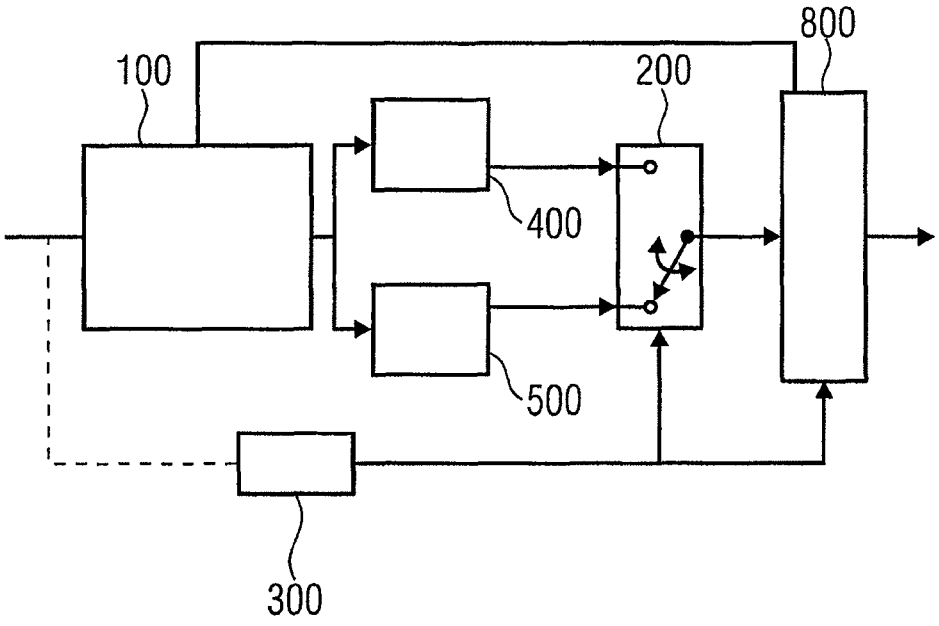
FIG. 4*b* illustrates a block diagram of an encoding scheme with the switch positioned subsequent to encoding the branches.

FIGS. 4*a* and 4*b* illustrate two different embodiments, which differ in the positioning of the switch 200. In FIG. 4*a*, the switch 200 is positioned between an output of the common pre-processing stage 100 and input of the two encoded branches 400, 500. The FIG. 4*a* embodiment makes sure that the audio signal is input into a single encoding branch only, and the other encoding branch, which is not connected to the output of the common pre-processing stage does not operate and, therefore, is switched off or is in a sleep mode. This embodiment is advantageous in that the non-active encoding branch does not consume power and computational resources which is useful for mobile applications in particular, which are battery-powered and, therefore, have the general limitation of power consumption.

On the other hand, however, the FIG. 4*b* embodiment may be advantageous when power consumption is not an issue. In this embodiment, both encoding branches 400, 500 are active all the time, and only the output of the selected encoding branch for a certain time portion and/or a certain frequency portion is forwarded to the bit stream formatter which may be implemented as a bit stream multiplexer 800. Therefore, in the FIG. 4*b* embodiment, both encoding branches are active all the time, and the output of an encoding branch which is selected by the decision stage 300 is entered into the output bit stream, while the output of the other non-selected encoding branch 400 is discarded, i.e., not entered into the output bit stream, i.e., the encoded audio signal.

Figure 4C:
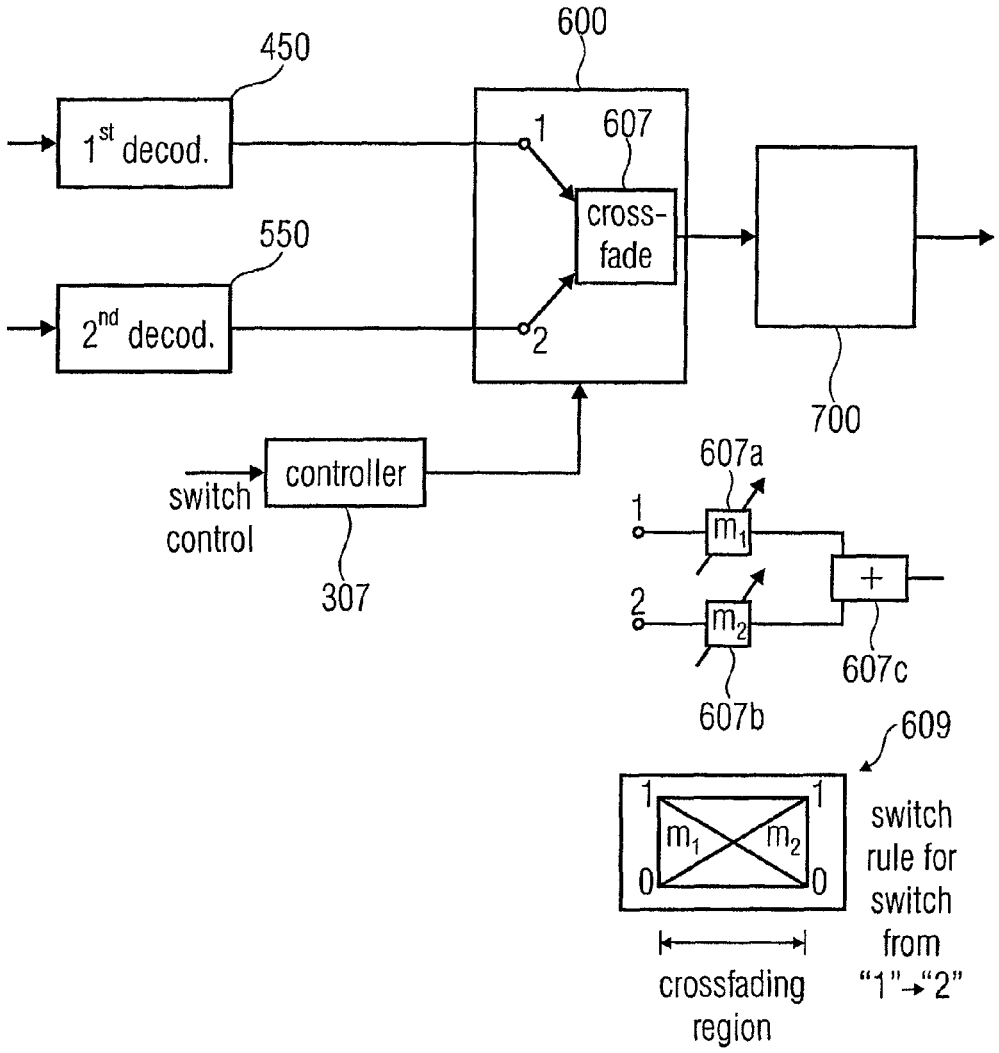
FIG. 4*c* illustrates a block diagram for a combiner embodiment.

FIG. 4*c* illustrates a further aspect of a decoder implementation. In order to avoid audible artefacts specifically in the situation, in which the first decoder is a time-aliasing generating decoder or generally stated a frequency domain decoder and the second decoder is a time domain device, the boarders between blocks or frames output by the first decoder 450 and the second decoder 550 should not be fully continuous, specifically in a switching situation. Thus, when the first block of the first decoder 450 is output and, when for the subsequent time portion, a block of the second decoder is output, it is advantageous to perform a cross fading operation as illustrated by cross fade block 607. To this end, the cross fade block 607 might be implemented as illustrated in FIGS. 4*c* at 607*a*, 607*b* and 607*c*. Each branch might have a weighter having a weighting factor $m_1$ between 0 and 1 on the normalized scale, where the weighting factor can vary as indicated in the plot 609, such a cross fading rule makes sure that a continuous and smooth cross fading takes place which, additionally, assures that a user will not perceive any loudness variations.

In certain instances, the last block of the first decoder was generated using a window where the window actually performed a fade out of this block. In this case, the weighting factor $m_1$ in block 607*a* is equal to 1 and, actually, no weighting at all is needed for this branch.

When a switch from the second decoder to the first decoder takes place, and when the second decoder includes a window which actually fades out the output to the end of the block, then the weighter indicated with "$m_2$" would not be needed or the weighting parameter can be set to 1 throughout the whole cross fading region.

When the first block after a switch was generated using a windowing operation, and when this window actually performed a fade in operation, then the corresponding weighting factor can also be set to 1 so that a weighter is not really necessary. Therefore, when the last block is windowed in order to fade out by the decoder and when the first block after the switch is windowed using the decoder in order to provide a fade in, then the weighters 607*a*, 607*b* are not needed at all and an addition operation by adder 607*c* is sufficient.

In this case, the fade out portion of the last frame and the fade in portion of the next frame define the cross fading region indicated in block 609. Furthermore, it is advantageous in such a situation that the last block of one decoder has a certain time overlap with the first block of the other decoder.

If a cross fading operation is not needed or not possible or not desired, and if only a hard switch from one decoder to the other decoder is there, it is advantageous to perform such a switch in silent passages of the audio signal or at least in passages of the audio signal where there is low energy, i.e., which are perceived to be silent or almost silent. The decision stage 300 assures in such an embodiment that the switch 200 is only activated when the corresponding time portion which follows the switch event has an energy which is, for example, lower than the mean energy of the audio signal and is lower than 50% of the mean energy of the audio signal related to, for example, two or even more time portions/frames of the audio signal.

The second encoding rule/decoding rule is an LPC-based coding algorithm. In LPC-based speech coding, a differentiation between quasi-periodic impulse-like excitation signal segments or signal portions, and noise-like excitation signal segments or signal portions, is made.

Quasi-periodic impulse-like excitation signal segments, i.e., signal segments having a specific pitch are coded with different mechanisms than noise-like excitation signals. While quasi-periodic impulse-like excitation signals are connected to voiced speech, noise-like signals are related to unvoiced speech.

Figures 5A, 5B:
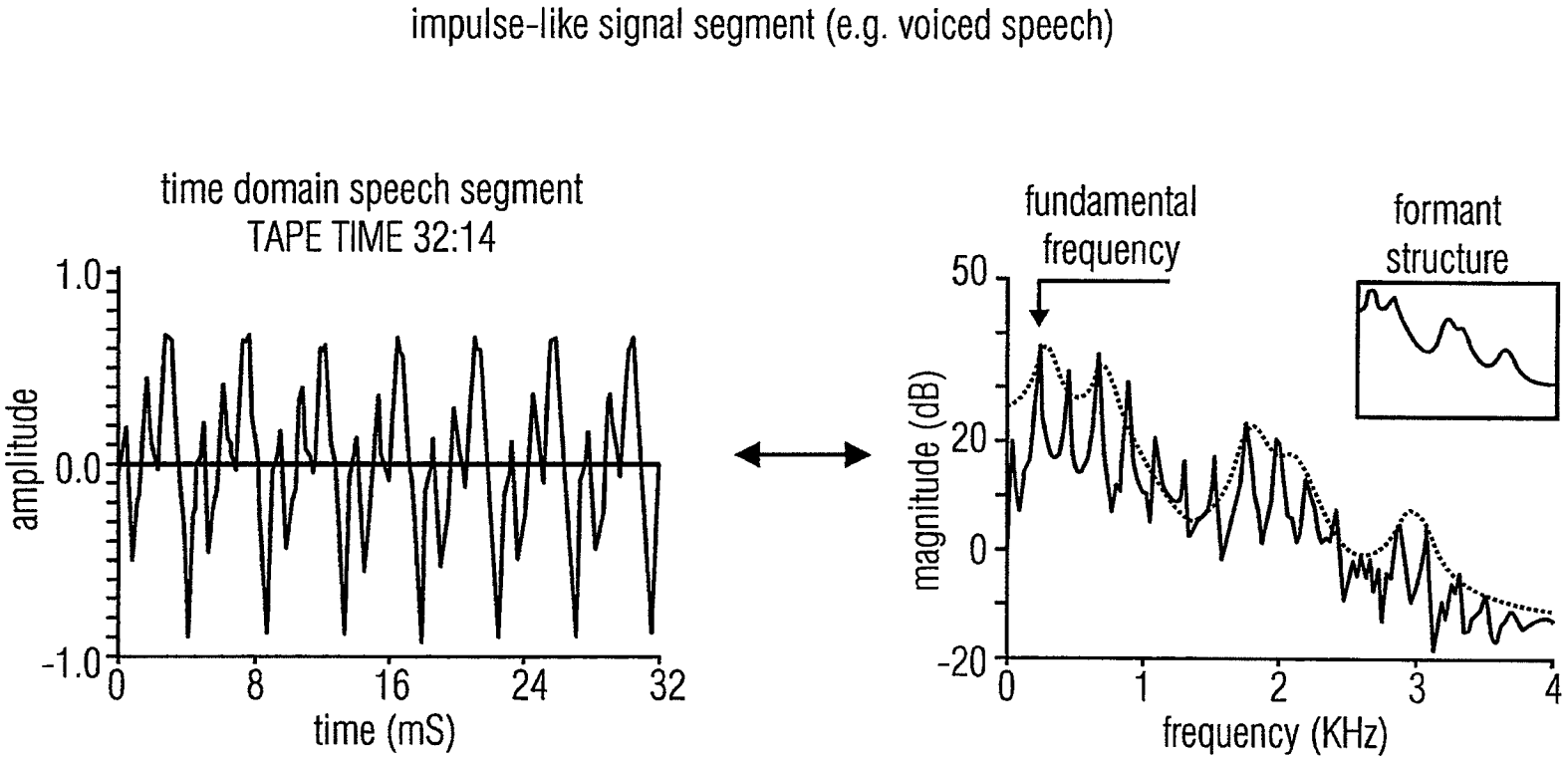
FIG. 5*a* illustrates a wave form of a time domain speech segment as a quasi-periodic or impulse-like signal segment.
FIG. 5*b* illustrates a spectrum of the segment of FIG. 5*a;*

Exemplarily, reference is made to FIGS. 5*a* to 5*d*. Here, quasi-periodic impulse-like signal segments or signal portions and noise-like signal segments or signal portions are exemplarily discussed. Specifically, a voiced speech as illustrated in FIG. 5*a* in the time domain and in FIG. 5*b* in the frequency domain is discussed as an example for a quasi-periodic impulse-like signal portion, and an unvoiced speech segment as an example for a noise-like signal portion is discussed in connection with FIGS. 5*c* and 5*d*. Speech can generally be classified as voiced, unvoiced, or mixed. Time-and-frequency domain plots for sampled voiced and unvoiced segments are shown in FIGS. 5*a* to 5*d*. Voiced speech is quasi periodic in the time domain and harmonically structured in the frequency domain, while unvoiced speed is random-like and broadband. In addition, the energy of voiced segments is generally higher than the energy of unvoiced segments. The short-time spectrum of voiced speech is characterized by its fine and formant structure. The fine harmonic structure is a consequence of the quasiperiodicity of speech and may be attributed to the vibrating vocal chords. The formant structure (spectral envelope) is due to the interaction of the source and the vocal tracts. The vocal tracts consist of the pharynx and the mouth cavity. The shape of the spectral envelope that "fits" the short time spectrum of voiced speech is associated with the transfer characteristics of the vocal tract and the spectral tilt (6 dB/Octave) due to the glottal pulse. The spectral envelope is characterized by a set of peaks which are called formants. The formants are the resonant modes of the vocal tract. For the average vocal tract there are three to five formants below 5 kHz. The amplitudes and locations of the first three formants, usually occurring below 3 kHz are quite important both, in speech synthesis and perception. Higher formants are also important for wide band and unvoiced speech representations. The properties of speech are related to the physical speech production system as follows. Voiced speech is produced by exciting the vocal tract with quasi-periodic glottal air pulses generated by the vibrating vocal chords. The frequency of the periodic pulses is referred to as the fundamental frequency or pitch. Unvoiced speech is produced by forcing air through a constriction in the vocal tract. Nasal sounds are due to the acoustic coupling of the nasal tract to the vocal tract, and plosive sounds are produced by abruptly releasing the air pressure which was built up behind the closure in the tract.

Figures 5C, 5D:
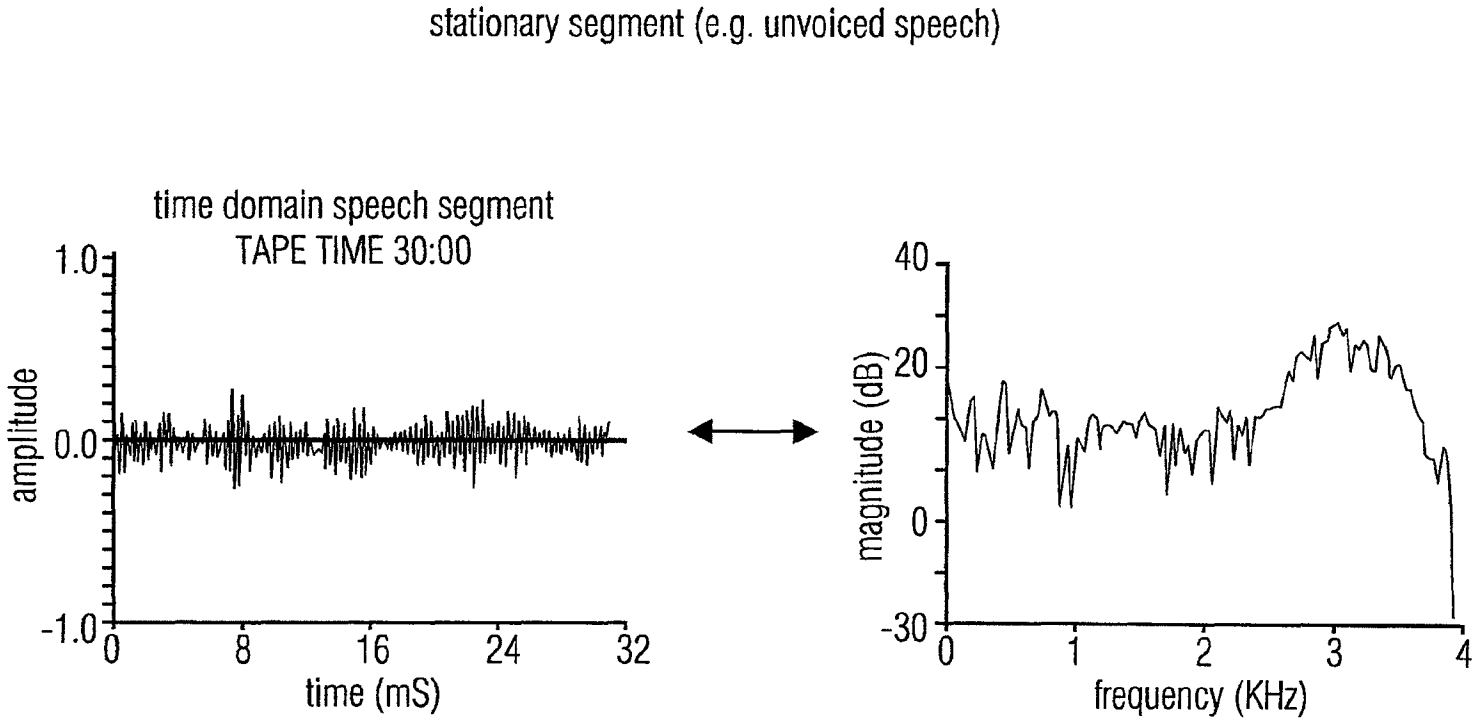
FIG. 5*c* illustrates a time domain speech segment of unvoiced speech as an example for a stationary and noise-like segment.
FIG. 5*d* illustrates a spectrum of the time domain wave form of FIG. 5*c;*

Thus, a noise-like portion of the audio signal does not show an impulse-like time-domain structure nor harmonic frequency-domain structure as illustrated in FIG. 5*c* and in FIG. 5*d*, which is different from the quasi-periodic impulse-like portion as illustrated for example in FIG. 5*a* and in FIG. 5*b*. As will be outlined later on, however, the differentiation between noise-like portions and quasiperiodic impulse-like portions can also be observed after a LPC for the excitation signal. The LPC is a method which models the vocal tract and extracts from the signal the excitation of the vocal tracts.

Furthermore, quasi-periodic impulse-like portions and noise-like portions can occur in a timely manner, i.e., which means that a portion of the audio signal in time is noisy and another portion of the audio signal in time is quasi-periodic, i.e. tonal. Alternatively, or additionally, the characteristic of a signal can be different in different frequency bands. Thus, the determination, whether the audio signal is noisy or tonal, can also be performed frequency-selective so that a certain frequency band or several certain frequency bands are considered to be noisy and other frequency bands are considered to be tonal. In this case, a certain time portion of the audio signal might include tonal components and noisy components.

Figure 7A:
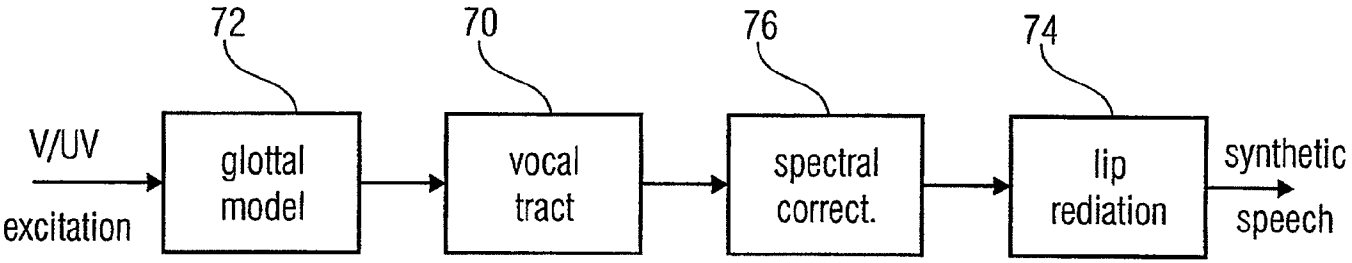
FIGS. 7*a* to 7*d* illustrate voiced/unvoiced excitation signals as an example for impulse-like and stationary/noise-like signals.
Figure 7B:
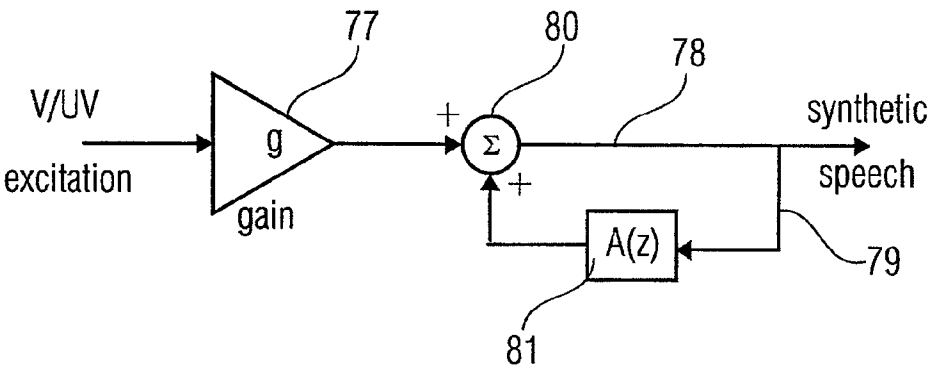
Figure 7C:
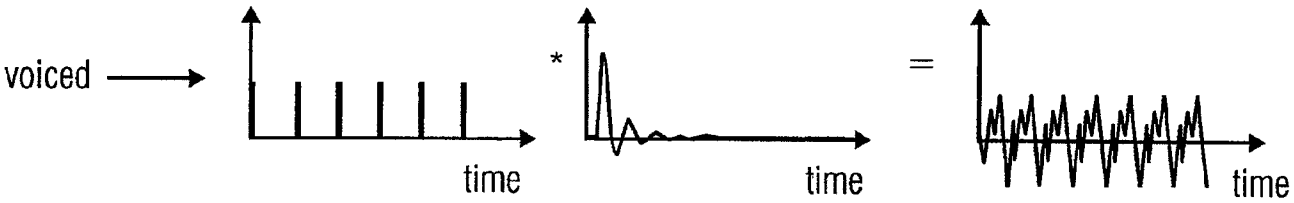
Figure 7D:
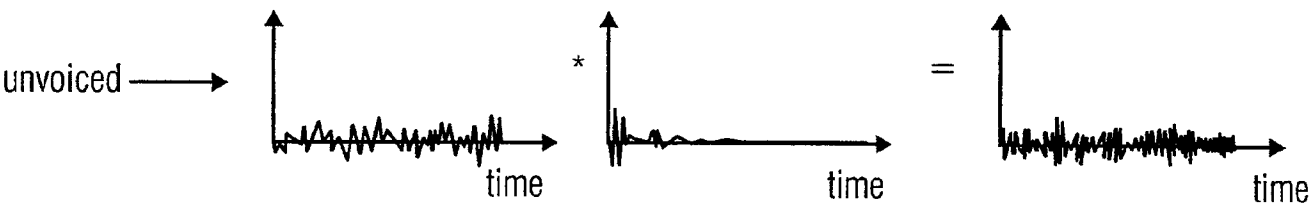

FIG. 7*a* illustrates a linear model of a speech production system. This system assumes a two-stage excitation, i.e., an impulse-train for voiced speech as indicated in FIG. 7*c*, and a random-noise for unvoiced speech as indicated in FIG. 7*d*. The vocal tract is modelled as an all-pole filter 70 which processes pulses or noise of FIG. 7*c* or FIG. 7*d*, generated by the glottal model 72. The all-pole transfer function is formed by a cascade of a small number of two-pole resonators representing the formants. The glottal model is represented as a two-pole low-pass filter, and the lipradiation model 74 is represented by $L(z)=1-z^{-1}$. Finally, a spectral correction factor 76 is included to compensate for the low-frequency effects of the higher poles. In individual speech representations the spectral correction is omitted and the 0 of the lip-radiation transfer function is essentially cancelled by one of the glottal poles. Hence, the system of FIG. 7*a* can be reduced to an all pole-filter model of FIG. 7*b* having a gain stage 77, a forward path 78, a feedback path 79, and an adding stage 80. In the feedback path 79, there is a prediction filter 81, and the whole source-model synthesis system illustrated in FIG. 7*b* can be represented using z-domain functions as follows:

$$S(z)=g/(1-A(z))\cdot X(z),$$

where g represents the gain, A(z) is the prediction filter as determined by an LPC analysis, X(z) is the excitation signal, and S(z) is the synthesis speech output.

FIGS. 7*c* and 7*d* give a graphical time domain description of voiced and unvoiced speech synthesis using the linear source system model. This system and the excitation parameters in the above equation are unknown and may be determined from a finite set of speech samples. The coefficients of A(z) are obtained using a linear prediction analysis of the input signal and a quantization of the filter coefficients. In a p-th order forward linear predictor, the present sample of the speech sequence is predicted from a linear combination of p passed samples. The predictor coefficients can be determined by well-known algorithms such as the Levinson-Durbin algorithm, or generally an autocorrelation method or a reflection method. The quantization of the obtained filter coefficients is usually performed by a multi-stage vector quantization in the LSF or in the ISP domain.

Figure 7E:
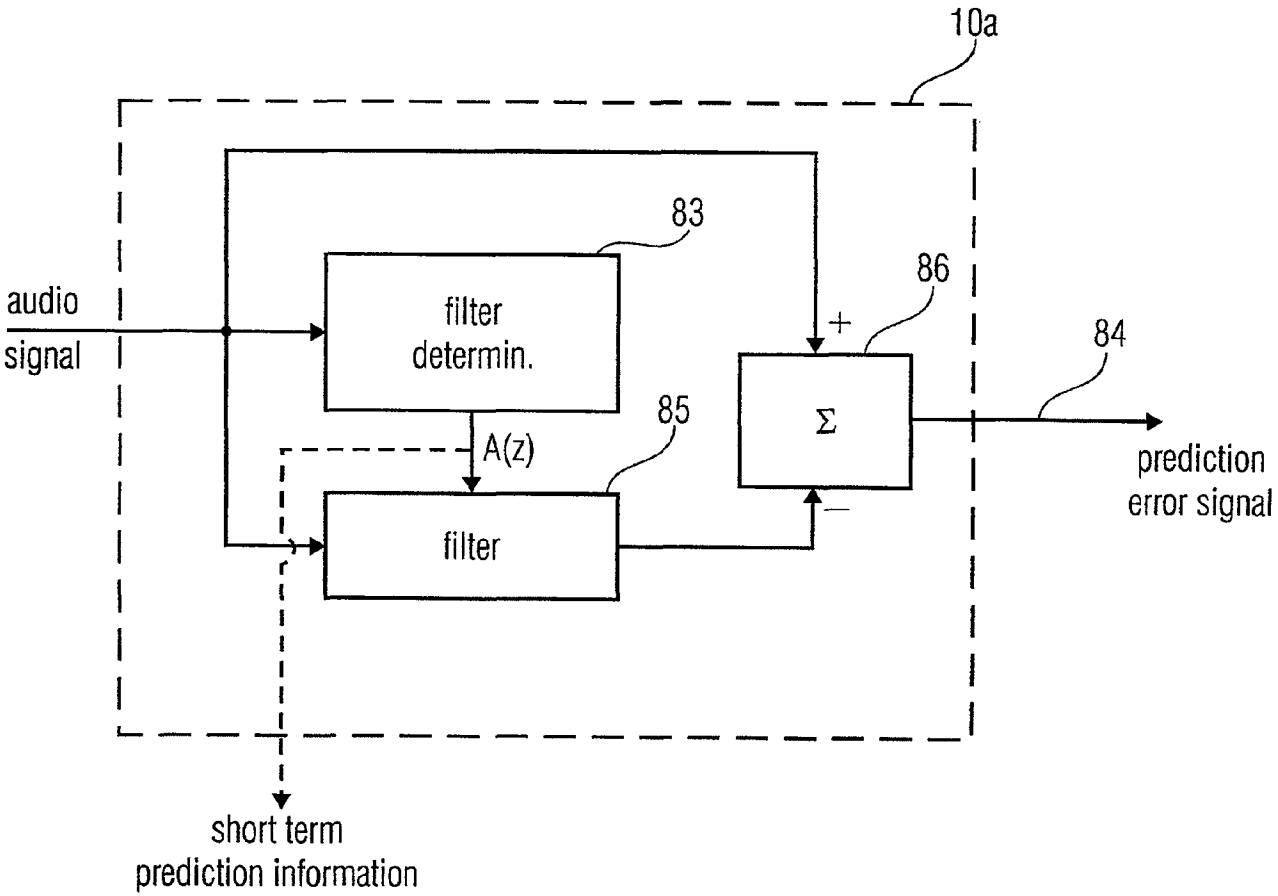
FIG. 7*e* illustrates an encoder-side LPC stage providing short-term prediction information and the prediction error signal.

FIG. 7*e* illustrates a more detailed implementation of an LPC analysis block, such as 510 of FIG. 1*a*. The audio signal is input into a filter determination block which determines the filter information A(z). This information is output as the short-term prediction information needed for a decoder. In the FIG. 4*a* embodiment, i.e., the short-term prediction information might be needed for the impulse coder output signal. When, however, only the prediction error signal at line 84 is needed, the short-term prediction information does not have to be output. Nevertheless, the short-term prediction information is needed by the actual prediction filter 85. In a subtracter 86, a current sample of the audio signal is input and a predicted value for the current sample is subtracted so that for this sample, the prediction error signal is generated at line 84. A sequence of such prediction error signal samples is very schematically illustrated in FIG. 7*c* or 7*d*, where, for clarity issues, any issues regarding AC/DC components, etc. have not been illustrated. Therefore, FIG. 7*c* can be considered as a kind of a rectified impulse-like signal.

Figure 6:
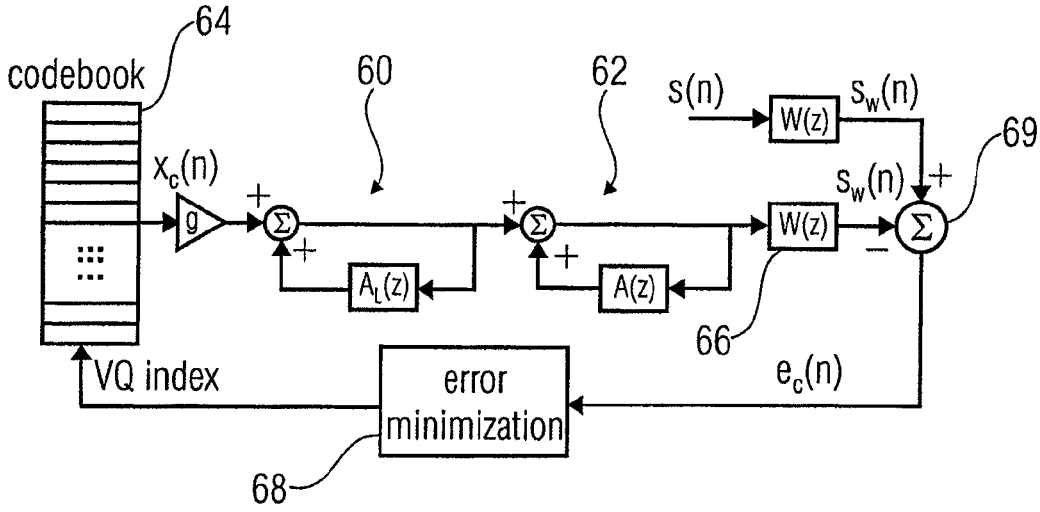
FIG. 6 illustrates a block diagram of an analysis by synthesis CELP encoder.

Subsequently, an analysis-by-synthesis CELP encoder will be discussed in connection with FIG. 6 in order to illustrate the modifications applied to this algorithm, as illustrated in FIGS. 10 to 13. This CELP encoder is discussed in detail in "Speech Coding: A Tutorial Review", Andreas Spaniels, Proceedings of the IEEE, Vol. 82, No. 10, October 1994, pages 1541-1582. The CELP encoder as illustrated in FIG. 6 includes a long-term prediction component 60 and a short-term prediction component 62. Furthermore, a codebook is used which is indicated at 64. A perceptual weighting filter W(z) is implemented at 66, and an error minimization controller is provided at 68. s(n) is the time-domain input signal. After having been perceptually weighted, the weighted signal is input into a subtracter 69, which calculater the error between the weighted synthesis signal at the output of block 66 and the original weighted signal $s_w(n)$. Generally, the short-term prediction A(z) is calculated and its coefficients are quantized by a LPC analysis stage as indicated in FIG. 7*e*. The long-term prediction information $A_L(z)$ including the long-term prediction gain g and the vector quantization index, i.e., codebook references are calculated on the prediction error signal at the output of the LPC analysis stage referred as 10*a* in FIG. 7*e*. The CELP algorithm encodes then the residual signal obtained after the short-term and long-term predictions using a codebook of for example Gaussian sequences. The ACELP algorithm, where the "A" stands for "Algebraic" has a specific algebraically designed codebook.

A codebook may contain more or less vectors where each vector is some samples long. A gain factor g scales the code vector and the gained code is filtered by the long-term prediction synthesis filter and the short-term prediction synthesis filter. The "optimum" code vector is selected such that the perceptually weighted mean square error at the output of the subtracter 69 is minimized. The search process in CELP is done by an analysis-by-synthesis optimization as illustrated in FIG. 6.

For specific cases, when a frame is a mixture of unvoiced and voiced speech or when speech over music occurs, a TCX coding can be more appropriate to code the excitation in the LPC domain. The TCX coding processes directly the excitation in the frequency domain without doing any assumption of excitation production. The TCX is then more generic than CELP coding and is not restricted to a voiced or a non-voiced source model of the excitation. TCX is still a source-filer model coding using a linear predictive filter for modelling the formants of the speech-like signals.

In the AMR-WB+-like coding, a selection between different TCX modes and ACELP takes place as known from the AMR-WB+ description. The TCX modes are different in that the length of the block-wise Fast Fourier Transform is different for different modes and the best mode can be selected by an analysis by synthesis approach or by a direct "feed-forward" mode.

As discussed in connection with FIGS. 2*a* and 2*b*, the common pre-processing stage 100 advantageously includes a joint multi-channel (surround/joint stereo device) 101 and, additionally, a band width extension stage 102. Correspondingly, the decoder includes a band width extension stage 701 and a subsequently connected joint multichannel stage 702. The joint multichannel stage 101 is, with respect to the encoder, connected before the band width extension stage 102, and, on the decoder side, the band width extension stage 701 is connected before the joint multichannel stage 702 with respect to the signal processing direction. Alternatively, however, the common pre-processing stage can include a joint multichannel stage without the subsequently connected bandwidth extension stage or a bandwidth extension stage without a connected joint multichannel stage.

Figure 8:
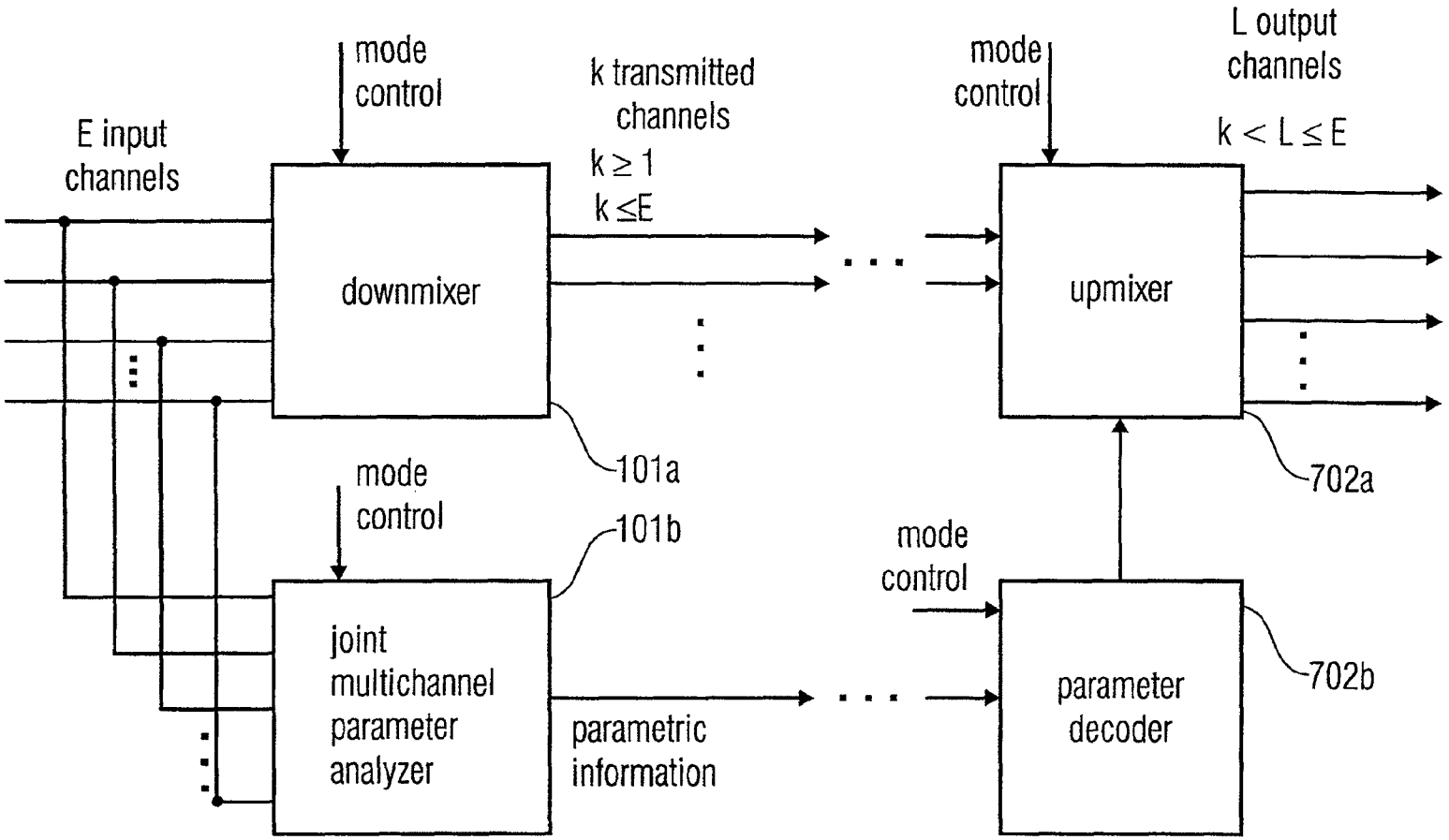
FIG. 8 illustrates a block diagram of a joint multichannel algorithm in accordance with an embodiment of the present invention.

An example for a joint multichannel stage on the encoder side 101*a*, 101*b* and on the decoder side 702*a* and 702*b* is illustrated in the context of FIG. 8. A number of E original input channels is input into the downmixer 101*a* so that the downmixer generates a number of K transmitted channels, where the number K is greater than or equal to one and is smaller than E.

Advantageously, the E input channels are input into a joint multichannel parameter analyser 101*b* which generates parametric information. This parametric information is entropy-encoded such as by a different encoding and subsequent Huffman encoding or, alternatively, subsequent arithmetic encoding. The encoded parametric information output by block 101*b* is transmitted to a parameter decoder 702*b* which may be part of item 702 in FIG. 2*b*. The parameter decoder 702*b* decodes the transmitted parametric information and forwards the decoded parametric information into the upmixer 702*a*. The upmixer 702*a* receives the K transmitted channels and generates a number of L output channels, where the number of L is greater than K and lower than or equal to E.

Parametric information may include inter channel level differences, inter channel time differences, inter channel phase differences and/or inter channel coherence measures as is known from the BCC technique or as is known and is described in detail in the MPEG surround standard. The number of transmitted channels may be a single mono channel for ultra-low bit rate applications or may include a compatible stereo application or may include a compatible stereo signal, i.e., two channels. Typically, the number of E input channels may be five or maybe even higher. Alternatively, the number of E input channels may also be E audio objects as it is known in the context of spatial audio object coding (SAOC).

In one implementation, the downmixer performs a weighted or unweighted addition of the original E input channels or an addition of the E input audio objects. In case of audio objects as input channels, the joint multichannel parameter analyser 101*b* will calculate audio object parameters such as a correlation matrix between the audio objects advantageously for each time portion and even more advantageously for each frequency band. To this end, the whole frequency range may be divided in at least 10 and advantageously 32 or 64 frequency bands.

Figure 9:
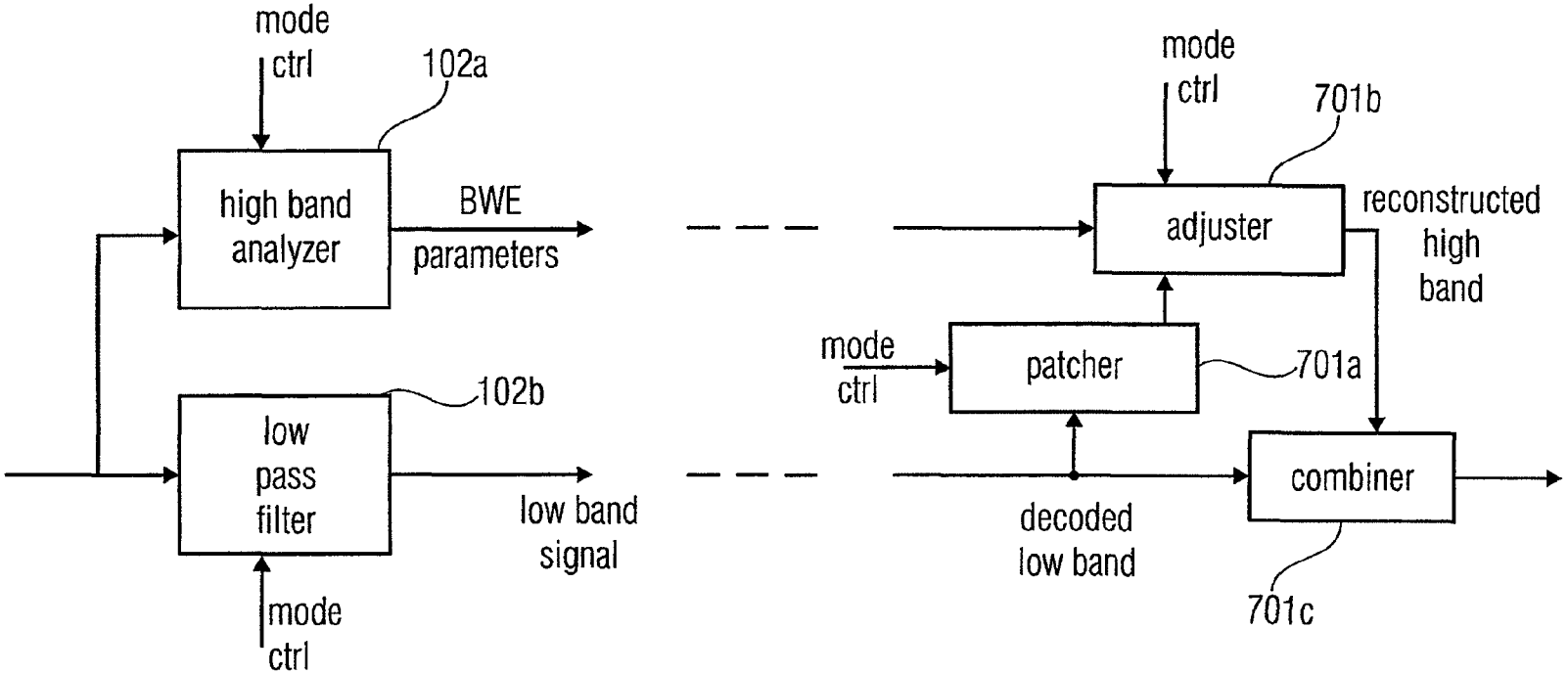
FIG. 9 illustrates an embodiment of a bandwidth extension algorithm.

FIG. 9 illustrates an embodiment for the implementation of the bandwidth extension stage 102 in FIG. 2*a* and the corresponding band width extension stage 701 in FIG. 2*b*. On the encoder-side, the bandwidth extension block 102 includes a low pass filtering block 102*b* and a high band analyser 102*a*. The original audio signal input into the bandwidth extension block 102 is low-pass filtered to generate the low band signal which is then input into the encoding branches and/or the switch. The low pass filter has a cut off frequency which is typically in a range of 3 kHz to 10 kHz. Using SBR, this range can be exceeded. Furthermore, the bandwidth extension block 102 furthermore includes a high band analyser for calculating the bandwidth extension parameters such as a spectral envelope parameter information, a noise floor parameter information, an inverse filtering parameter information, further parametric information relating to certain harmonic lines in the high band and additional parameters as discussed in detail in the MPEG-4 standard in the chapter related to spectral band replication (ISO/IEC 14496-3:2005, Part 3, Chapter 4.6.18).

On the decoder-side, the bandwidth extension block 701 includes a patcher 701*a*, an adjuster 701*b* and a combiner 701*c*. The combiner 701*c* combines the decoded low band signal and the reconstructed and adjusted high band signal output by the adjuster 701*b*. The input into the adjuster 701*b* is provided by a patcher which is operated to derive the high band signal from the low band signal such as by spectral band replication or, generally, by bandwidth extension. The patching performed by the patcher 701*a* may be a patching performed in a harmonic way or in a non-harmonic way. The signal generated by the patcher 701*a* is, subsequently, adjusted by the adjuster 701*b* using the transmitted parametric bandwidth extension information.

As indicated in FIG. 8 and FIG. 9, the described blocks may have a mode control input in an embodiment. This mode control input is derived from the decision stage 300 output signal. In such an embodiment, a characteristic of a corresponding block may be adapted to the decision stage output, i.e., whether, in an embodiment, a decision to speech or a decision to music is made for a certain time portion of the audio signal. Advantageously, the mode control only relates to one or more of the functionalities of these blocks but not to all of the functionalities of blocks. For example, the decision may influence only the patcher 701*a* but may not influence the other blocks in FIG. 9, or may, for example, influence only the joint multichannel parameter analyser 101*b* in FIG. 8 but not the other blocks in FIG. 8. This implementation is such that a higher flexibility and higher quality and lower bit rate output signal is obtained by providing flexibility in the common pre-processing stage. On the other hand, however, the usage of algorithms in the common pre-processing stage for both kinds of signals allows to implement an efficient encoding/decoding scheme.

Figure 10A:
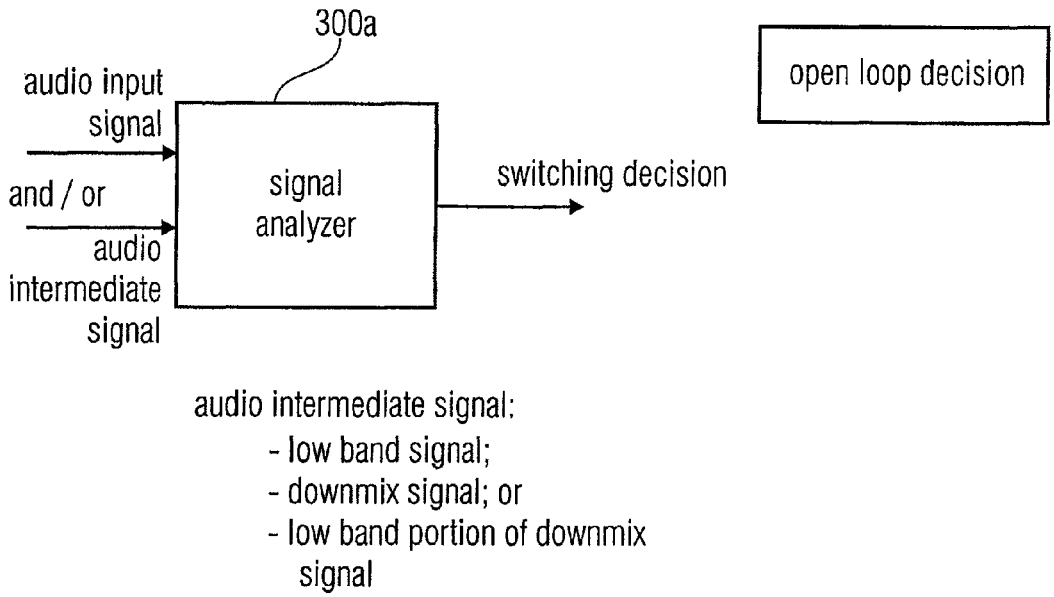
FIG. 10*a* illustrates a detailed description of the switch when performing an open loop decision.
Figure 10B:
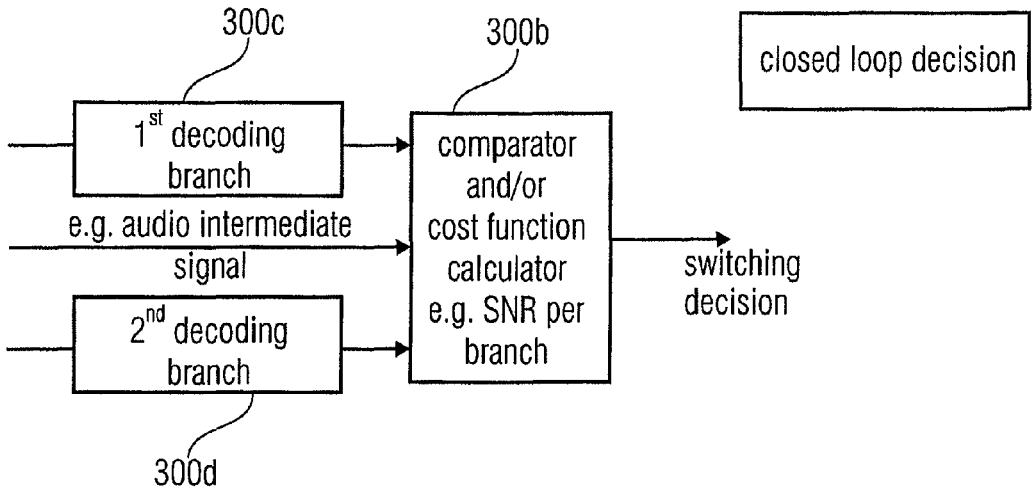
FIG. 10*b* illustrates an embodiment of the switch when operating in a closed loop decision mode.

FIG. 10*a* and FIG. 10*b* illustrates two different implementations of the decision stage 300. In FIG. 10*a*, an open loop decision is indicated. Here, the signal analyser 300*a* in the decision stage has certain rules in order to decide whether the certain time portion or a certain frequency portion of the input signal has a characteristic which requests that this signal portion is encoded by the first encoding branch 400 or by the second encoding branch 500. To this end, the signal analyser 300*a* may analyse the audio input signal into the common pre-processing stage or may analyse the audio signal output by the common preprocessing stage, i.e., the audio intermediate signal or may analyse an intermediate signal within the common preprocessing stage such as the output of the downmix signal which may be a mono signal or which may be a signal having k channels indicated in FIG. 8. On the output-side, the signal analyser 300*a* generates the switching decision for controlling the switch 200 on the encoder-side and the corresponding switch 600 or the combiner 600 on the decoder-side.

Alternatively, the decision stage 300 may perform a closed loop decision, which means that both encoding branches perform their tasks on the same portion of the audio signal and both encoded signals are decoded by corresponding decoding branches 300*c*, 300*d*. The output of the devices 300*c* and 300*d* is input into a comparator 300*b* which compares the output of the decoding devices to the corresponding portion of the, for example, audio intermediate signal. Then, dependent on a cost function such as a signal to noise ratio per branch, a switching decision is made. This closed loop decision has an increased complexity compared to the open loop decision, but this complexity is only existing on the encoder-side, and a decoder does not have any disadvantage from this process, since the decoder can advantageously use the output of this encoding decision. Therefore, the closed loop mode is advantageous due to complexity and quality considerations in applications, in which the complexity of the decoder is not an issue such as in broadcasting applications where there is only a small number of encoders but a large number of decoders which, in addition, have to be smart and cheap.

The cost function applied by the comparator 300*b* may be a cost function driven by quality aspects or may be a cost function driven by noise aspects or may be a cost function driven by bit rate aspects or may be a combined cost function driven by any combination of bit rate, quality, noise (introduced by coding artefacts, specifically, by quantization), etc.

Advantageously, the first encoding branch and/or the second encoding branch includes a time warping functionality in the encoder side and correspondingly in the decoder side. In one embodiment, the first encoding branch comprises a time warper module for calculating a variable warping characteristic dependent on a portion of the audio signal, a resampler for re-sampling in accordance with the determined warping characteristic, a time domain/frequency domain converter, and an entropy coder for converting a result of the time domain/frequency domain conversion into an encoded representation. The variable warping characteristic is included in the encoded audio signal. This information is read by a time warp enhanced decoding branch and processed to finally have an output signal in a non-warped time scale. For example, the decoding branch performs entropy decoding, dequantization and a conversion from the frequency domain back into the time domain. In the time domain, the dewarping can be applied and may be followed by a corresponding resampling operation to finally obtain a discrete audio signal with a non-warped time scale.

Depending on certain implementation requirements of the inventive methods, the inventive methods can be implemented in hardware or in software. The implementation can be performed using a digital storage medium, in particular, a disc, a DVD or a CD having electronically-readable control signals stored thereon, which co-operate with programmable computer systems such that the inventive methods are performed. Generally, the present invention is therefore a computer program product with a program code stored on a machine-readable carrier, the program code being operated for performing the inventive methods when the computer program product runs on a computer. In other words, the inventive methods are, therefore, a computer program having a program code for performing at least one of the inventive methods when the computer program runs on a computer.

The inventive encoded audio signal can be stored on a digital storage medium or can be transmitted on a transmission medium such as a wireless transmission medium or a wired transmission medium such as the Internet.

The above described embodiments are merely illustrative for the principles of the present invention. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. Audio encoder for generating an encoded audio signal, comprising:

a first encoding branch for encoding an audio intermediate signal in accordance with a first coding algorithm, the first coding algorithm comprising an information sink model and generating, in a first encoding branch output signal, encoded spectral information representing the audio intermediate signal, the first encoding branch comprising a spectral conversion block for converting the audio intermediate signal into a spectral domain and a spectral audio encoder for encoding an output signal of the spectral conversion block to acquire the encoded spectral information;

a second encoding branch for encoding an audio intermediate signal in accordance with a second coding algorithm, the second coding algorithm comprising an information source model and generating, in a second encoding branch output signal, encoded parameters for the information source model representing the audio intermediate signal, the second encoding branch comprising an LPC analyzer for analyzing the audio intermediate signal and for outputting an LPC information signal usable for controlling an LPC synthesis filter and an excitation signal, and an excitation encoder for encoding the excitation signal to acquire the encoded parameters; and a common pre-processing stage for pre-processing an audio input signal to acquire the audio intermediate signal, wherein the common pre-processing stage is operative to process the audio input signal so that the audio intermediate signal is a compressed version of the audio input signal.

2. Audio encoder in accordance with claim 1, further comprising a switching stage connected between the first encoding branch and the second encoding branch at inputs into the branches or outputs of the branches, the switching stage being controlled by a switching control signal.

3. Audio encoder in accordance with claim 2, further comprising a decision stage for analyzing the audio input signal or the audio intermediate signal or an intermediate signal in the common pre-processing stage in time or frequency in order to find a time or frequency portion of a signal to be transmitted in an encoder output signal either as the encoded output signal generated by the first encoding branch or the encoded output signal generated by the second encoding branch.

4. Audio encoder in accordance with claim 1, in which the common pre-processing stage is operative to calculate common pre-processing parameters for a portion of the audio input signal not comprised in a first and a different second portion of the audio intermediate signal and to introduce an encoded representation of the pre-processing parameters in the encoded output signal, wherein the encoded output signal additionally comprises a first encoding branch output signal for representing a first portion of the audio intermediate signal and a second encoding branch output signal for representing the second portion of the audio intermediate signal.

5. Audio encoder in accordance with claim 1, in which the common pre-processing stage comprises a joint multichannel module, the joint multichannel module comprising:

a downmixer for generating a number of downmixed channels being greater than or equal to 1 and being smaller than a number of channels input into the downmixer; and a multichannel parameter calculator for calculating multichannel parameters so that, using the multichannel parameters and the number of downmixed channels, a representation of the original channel is performable.

6. Apparatus in accordance with claim 5, in which the multichannel parameters are interchannel level difference parameters, interchannel correlation or coherence parameters, interchannel phase difference parameters, interchannel time difference parameters, audio object parameters or direction or diffuseness parameters.

7. Audio encoder in accordance with claim 1, in which the common pre-processing stage comprises a band width extension analysis stage, comprising:

a band-limiting device for rejecting a high band in an input signal and for generating a low band signal; and a parameter calculator for calculating band width extension parameters for the high band rejected by the band-limiting device, wherein the parameter calculator is such that using the calculated parameters and the low band signal, a reconstruction of a bandwidth extended input signal is performable.

8. Audio encoder in accordance with claim 1, in which the common pre-processing stage comprises a joint multichannel module, a bandwidth extension stage, and a switch for switching between the first encoding branch and the second encoding branch, wherein an output of the joint multichannel stage is connected to an input of the bandwidth extension stage, and an output of the bandwidth extension stage is connected to an input of the switch, a first output of the switch is connected to an input of the first encoding branch and a second output of the switch is connected to an input of the second encoding branch, and outputs of the encoding branches are connected to a bit stream former.

9. Audio encoder in accordance with claim 3, in which the decision stage is operative to analyze a decision stage input signal for searching for portions to be encoded by the first encoding branch with a better signal to noise ratio at a certain bit rate compared to the second encoding branch, wherein the decision stage is operative to analyze based on an open loop algorithm without an encoded and again decoded signal or based on a closed loop algorithm using an encoded and again decoded signal.

10. Audio encoder in accordance with claim 3, wherein the common pre-processing stage comprises a specific number of functionalities and wherein at least one functionality is adaptable by a decision stage output signal and wherein at least one functionality is non-adaptable.

11. Audio encoder in accordance with claim 1, in which the first encoding branch comprises a time warper module for calculating a variable warping characteristic dependent on a portion of the audio signal, in which the first encoding branch comprises a resampler for re-sampling in accordance with a determined warping characteristic, and in which the first encoding branch comprises a time domain/frequency domain converter and an entropy coder for converting a result of the time domain/frequency domain conversion into an encoded representation, wherein the variable warping characteristic is comprised in the encoded audio signal.

12. Audio encoder in accordance with claim 1, in which the common pre-processing stage is operative to output at least two intermediate signals, and wherein, for each audio intermediate signal, the first and the second coding branch and a switch for switching between the two branches is provided.

13. Method of audio encoding for generating an encoded audio signal, comprising:

encoding an audio intermediate signal in accordance with a first coding algorithm, the first coding algorithm comprising an information sink model and generating, in a first output signal, encoded spectral information representing the audio signal, the first coding algorithm comprising a spectral conversion step of converting the audio intermediate signal into a spectral domain and a spectral audio encoding step of encoding an output signal of the spectral conversion step to acquire the encoded spectral information;

encoding an audio intermediate signal in accordance with a second coding algorithm, the second coding algorithm comprising an information source model and generating, in a second output signal, encoded parameters for the information source model representing the intermediate signal, the second encoding branch comprising a step of LPC analyzing the audio intermediate signal and outputting an LPC information signal usable for controlling an LPC synthesis filter, and an excitation signal, and a step of excitation encoding the excitation signal to acquire the encoded parameters; and commonly pre-processing an audio input signal to acquire the audio intermediate signal, wherein, in the step of commonly pre-processing the audio input signal is processed so that the audio intermediate signal is a compressed version of the audio input signal, wherein the encoded audio signal comprises, for a certain portion of the audio signal either the first output signal or the second output signal.

14. Audio decoder for decoding an encoded audio signal, comprising:

a first decoding branch for decoding an encoded signal encoded in accordance with a first coding algorithm comprising an information sink model, the first decoding branch comprising a spectral audio decoder for spectral audio decoding the encoded signal encoded in accordance with a first coding algorithm comprising an information sink model, and a time-domain converter for converting an output signal of the spectral audio decoder into the time domain;

a second decoding branch for decoding an encoded audio signal encoded in accordance with a second coding algorithm comprising an information source model, the second decoding branch comprising an excitation decoder for decoding the encoded audio signal encoded in accordance with a second coding algorithm to acquire an LPC domain signal, and an LPC synthesis stage for receiving an LPC information signal generated by an LPC analysis stage and for converting the LPC domain signal into the time domain;

a combiner for combining time domain output signals from the time domain converter of the first decoding branch and the LPC synthesis stage of the second decoding branch to acquire a combined signal; and a common post-processing stage for processing the combined signal so that a decoded output signal of the common post-processing stage is an expanded version of the combined signal.

15. Audio decoder in accordance with claim 14, in which the combiner comprises a switch for switching decoded signals from the first decoding branch and the second decoding branch in accordance with a mode indication explicitly or implicitly comprised in the encoded audio signal so that the combined audio signal is a continuous discrete time domain signal.

16. Audio decoder in accordance with claim 14, in which the combiner comprises a cross fader for cross fading, in case of a switching event, between an output of a decoding branch and an output of the other decoding branch within a time domain cross fading region.

17. Audio decoder in accordance with claim 16, in which the cross fader is operative to weight at least one of the decoding branch output signals within the cross fading region and to add at least one weighted signal to a weighted or unweighted signal from the other encoding branch, wherein weights used for weighting the at least one signal are variable in the cross fading region.

18. Audio decoder in accordance with claim 14, in which the common pre-processing stage comprises at least one of a joint multichannel decoder or a bandwidth extension processor.

19. Audio decoder in accordance with claim 18, in which the joint multichannel decoder comprises a parameter decoder and an upmixer controlled by a parameter decoder output.

20. Audio decoder in accordance with claim 19, in which the bandwidth extension processor comprises a patcher for creating a high band signal, an adjuster for adjusting the high band signal, and a combiner for combining the adjusted high band signal and a low band signal to acquire a bandwidth extended signal.

21. Audio decoder in accordance with claim 14, in which the first decoding branch comprises a frequency domain audio decoder, and the second decoding branch comprises a time domain speech decoder.

22. Audio decoder in accordance with claim 14, in which the first decoding branch comprises a frequency domain audio decoder, and the second decoding branch comprises a LPC-based decoder.

23. Audio decoder in accordance with claim 14, wherein the common post-processing stage comprises a specific number of functionalities and wherein at least one functionality is adaptable by a mode detection function and wherein at least one functionality is non-adaptable.

24. Method of audio decoding an encoded audio signal, comprising:

decoding an encoded signal encoded in accordance with a first coding algorithm comprising an information sink model, comprising spectral audio decoding the encoded signal encoded in accordance with a first coding algorithm comprising an information sink model, and time domain converting an output signal of the spectral audio decoding step into the time domain;

decoding an encoded audio signal encoded in accordance with a second coding algorithm comprising an information source model, comprising excitation decoding the encoded audio signal encoded in accordance with a second coding algorithm to acquire an LPC domain signal, an for receiving an LPC information signal generated by an LPC analysis stage and LPC synthesizing to convert the LPC domain signal into the time domain;

combining time domain output signals from the step of time domain converting and the step of LPC synthesizing to acquire a combined signal; and commonly processing the combined signal so that a decoded output signal obtained by the commonly processing is an expanded version of the combined signal.

25. A non-transitory storage medium having stored thereon a computer program for performing, when running on a computer, the method of audio encoding for generating an encoded audio signal, comprising:

encoding an audio intermediate signal in accordance with a first coding algorithm, the first coding algorithm comprising an information sink model and generating, in a first output signal, encoded spectral information representing the audio signal, the first coding algorithm comprising a spectral conversion step of converting the audio intermediate signal into a spectral domain and a spectral audio encoding step of encoding an output signal of the spectral conversion step to acquire the encoded spectral information;

encoding an audio intermediate signal in accordance with a second coding algorithm, the second coding algorithm comprising an information source model and generating, in a second output signal, encoded parameters for the information source model representing the intermediate signal, the second encoding branch comprising a step of LPC analyzing the audio intermediate signal and outputting an LPC information signal usable for controlling an LPC synthesis filter, and an excitation signal, and a step of excitation encoding the excitation signal to acquire the encoded parameters; and commonly pre-processing an audio input signal to acquire the audio intermediate signal, wherein, in the step of commonly pre-processing the audio input signal is processed so that the audio intermediate signal is a compressed version of the audio input signal, wherein the encoded audio signal comprises, for a certain portion of the audio signal either the first output signal or the second output signal.

26. A non-transitory storage medium having stored thereon a computer program for performing, when running on a computer, the method of audio decoding an encoded audio signal, comprising:

decoding an encoded signal encoded in accordance with a first coding algorithm comprising an information sink model, comprising spectral audio decoding the encoded signal encoded in accordance with a first coding algorithm comprising an information sink model, and time domain converting an output signal of the spectral audio decoding step into the time domain;

decoding an encoded audio signal encoded in accordance with a second coding algorithm comprising an information source model, comprising excitation decoding the encoded audio signal encoded in accordance with a second coding algorithm to acquire an LPC domain signal, an for receiving an LPC information signal generated by an LPC analysis stage and LPC synthesizing to convert the LPC domain signal into the time domain;

combining time domain output signals from the step of time domain converting and the step of LPC synthesizing to acquire a combined signal; and commonly processing the combined signal so that a decoded output signal of the common post-processing stage is an expanded version of the combined signal.

* * * * *

UNITED STATES PATENT AND TRADEMARK OFFICE

CERTIFICATE OF CORRECTION

PATENT NO. : 8,804,970 B2
APPLICATION NO. : 13/004453
DATED : August 12, 2014
INVENTOR(S) : Bernhard Grill et al.

It is certified that error appears in the above-identified patent and that said Letters Patent is hereby corrected as shown below:

On the Title Page

Page 1, item (73) Assignee:

Fraunhofer-Gesellschaft zur Foederung der Angewandten Forshung E.V.

should read:

Fraunhofer-Gesellschaft zur Foerderung der angewandten Forschung e.V.

Signed and Sealed this
Ninth Day of June, 2015

Michelle K. Lee

Michelle K. Lee
*Director of the United States Patent and Trademark Office*